US009091994B2

(12) United States Patent
Huang

(10) Patent No.: US 9,091,994 B2
(45) Date of Patent: Jul. 28, 2015

(54) TRANSMISSION DEVICE FOR PHOTOSENSITIVE DRUM

(71) Applicant: GENERAL PLASTIC INDUSTRIAL CO., LTD., Taichung County (TW)

(72) Inventor: Shih-Chieh Huang, Taichung (TW)

(73) Assignee: GENERAL PLASTIC INDUSTRIAL CO., LTD., Taichung County (TW)

( * ) Notice: Subject to any disclaimer, the term of this patent is extended or adjusted under 35 U.S.C. 154(b) by 0 days.

(21) Appl. No.: 14/461,011

(22) Filed: Aug. 15, 2014

(65) Prior Publication Data

US 2015/0050050 A1 Feb. 19, 2015

Related U.S. Application Data

(63) Continuation-in-part of application No. 14/310,615, filed on Jun. 20, 2014, which is a continuation-in-part of application No. 13/965,856, filed on Aug. 13, 2013.

(51) Int. Cl.
*G03G 15/00* (2006.01)
*G03G 21/18* (2006.01)

(52) U.S. Cl.
CPC ..... *G03G 15/757* (2013.01); *G03G 21/1857* (2013.01)

(58) Field of Classification Search
CPC ..... G03G 15/757; G03G 21/1857; G03G 2221/1657; G03G 2215/00156
USPC ..... 399/167, 117
See application file for complete search history.

(56) References Cited

U.S. PATENT DOCUMENTS

| | | | | |
|---|---|---|---|---|
| 8,270,876 | B2 * | 9/2012 | Morioka et al. | 399/167 |
| 8,295,734 | B2 | 10/2012 | Ueno et al. | |
| 2011/0182619 | A1 * | 7/2011 | Batori et al. | 399/117 |
| 2011/0217073 | A1 * | 9/2011 | He | 399/111 |
| 2011/0255900 | A1 * | 10/2011 | Zhou et al. | 399/111 |
| 2012/0251175 | A1 * | 10/2012 | Peng et al. | 399/159 |
| 2012/0294649 | A1 * | 11/2012 | Kikuchi et al. | 399/117 |
| 2013/0322923 | A1 * | 12/2013 | Ikeda | 399/117 |

FOREIGN PATENT DOCUMENTS

| | | | |
|---|---|---|---|
| CN | 201532527 | U | 7/2010 |
| WO | 2012113289 | A1 | 8/2012 |
| WO | WO 2012113289 | A1 * | 8/2012 |
| WO | WO 2012152203 | A1 * | 11/2012 |

* cited by examiner

*Primary Examiner* — Walter L Lindsay, Jr.
*Assistant Examiner* — Rodney Bonnette
(74) *Attorney, Agent, or Firm* — Locke Lord LLP; Tim Tingkang Xia, Esq.

(57) ABSTRACT

A transmission device for a photosensitive drum includes a sleeve having at least one guiding groove, a transmission unit having a shaft disposed in the sleeve and capable of moving and rotating at the same time, an elastic member, and a gear member receiving the sleeve and the elastic member so that the elastic member exerts elastic force on the shaft of the transmission unit. The transmission unit has two L-shaped engagement blocks defining a receiving space therebetween. Each L-shaped engagement block has an inclined outer surface, an inner surface, an inclined top surface and an engagement concave connecting the inner and outer surfaces are is rotatably secured to a base. The engagement concaves are opened toward opposite directions for engagement with two pillars of a drive member of an electronic image forming apparatus. Accordingly, the transmission device can be connected with and separated from the drive member smoothly.

23 Claims, 28 Drawing Sheets

(B)

(A)

(B)

(A)

(B)

(A)

(B)

(A)

(B)

(A)

(B)

(A)

TRANSMISSION DEVICE FOR PHOTOSENSITIVE DRUM

CROSS-REFERENCE TO RELATED APPLICATIONS

This application is a continuation-in-part application of U.S. patent application Ser. No. 14/310,615, filed on filed Jun. 20, 2014, entitled "TRANSMISSION DEVICE FOR PHOTOSENSITIVE DRUM", by Shih-Chieh Huang, which is hereby incorporated herein in its entirety by reference This application also is a continuation-in-part application of U.S. patent application Ser. No. 13/965,856, filed on Aug. 13, 2013, entitled "TRANSMISSION DEVICE FOR PHOTOSENSITIVE DRUM", by Shih-Chieh Huang, now allowed, which is hereby incorporated herein in its entirety by reference.

Some references, which may include patents, patent applications, and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

FIELD OF THE INVENTION

The present invention relates generally to photosensitive drums mounted in electronic imaging devices, such as printers, copy machines, and so on, and more particularly, to a transmission device for a photosensitive drum.

BACKGROUND OF THE INVENTION

The background description provided herein is for the purpose of generally presenting the context of the present invention. Work of the presently named inventors, to the extent it is described in this background section, as well as aspects of the description that may not otherwise qualify as prior art at the time of filing, are neither expressly nor impliedly admitted as prior art against the present invention.

A photosensitive drum, which is one of the most important components of an electronic imaging device, is installed in a toner cartridge to conduct electricity when photosensitized and attract carbon powders at the same time to develop the to-be-printed document. A photosensitive drum primarily comprises a photosensitive cylinder and a transmission device attached to an end of the photosensitive cylinder. The transmission device is adapted to be connected with a drive member in a housing of an electronic image forming apparatus to transmit rotatory kinetic energy from the drive member to the photosensitive cylinder.

The conventional transmission device for a photosensitive drum, which comprises a transmission member capable of engagement with the drive member, is usually provided with the design that the transmission member can be pushed by the drive member to swing, such as which disclosed in U.S. Pat. No. 8,295,734, or the design that the transmission member can be pushed by the drive member to move axially, such as which disclosed in China Utility Model Patent No. CN201532527U. By means of the designs, the transmission member will be engaged with the drive member when the user puts the toner cartridge into the electronic image forming apparatus and separated from the drive member when the user takes the toner cartridge out of the electronic imaging device.

However, the conventional transmission device for a photosensitive drum, which is provided with a transmission member capable of swinging or moving axially, is complicated in structure so as to be difficult in manufacture and assembly.

Therefore, a heretofore unaddressed need exists in the art to address the aforementioned deficiencies and inadequacies.

SUMMARY OF THE INVENTION

The present invention has been accomplished in view of the above-noted circumstances. It is an objective of the present invention to provide a transmission device for a photosensitive drum, which can be connected with and separated from a drive member of an electronic image forming apparatus in a different way from the conventional ones and is simpler in structure. It is another objective of the present invention to provide a transmission device for a photosensitive drum, which can be connected with a drive member of an electronic image forming apparatus firmly and separated from the drive member smoothly.

To attain the above objectives, the present invention provides a transmission device for a photosensitive drum, which is adapted for engagement with a drive member of an electronic image forming apparatus provided with two pillars.

In aspect of the invention, the transmission device comprises a transmission unit. The transmission unit includes a shaft and an engagement structure. The shaft extends along an imaginary axis, and has a first end facing toward a first direction, a second end facing toward a second direction opposite to the first direction, and at least one protrusion extending along a radial direction of the shaft.

The engagement structure includes a base extending from the first end of the shaft; a notched receptacle defined in the base; and two L-shaped engagement blocks. Each L-shaped engagement block has a bottom member and an engagement claw, where the bottom member has a first end portion defining a hook and an opposite, second end portion, and the engagement claw extends vertically from the second end portion of the bottom member. The two L-shaped engagement blocks are pivotally received in two opposite sides of the notched receptacle, respectively, such that each L-shaped engagement block is rotatable around a pivotal axis at the second end portion of the bottom member, the pivotal axis being perpendicular to the imaginary axis, the first end portion of the bottom member is toward the imaginary axis and the engagement claw is helically toward the first direction in a normal state. The two L-shaped engagement blocks defines a receiving space therebetween for receiving the drive member.

In one embodiment, the shaft of the transmission unit has an opening in which a pin (40) is inserted; and the protrusion is a part of the pin sticking out of the opening.

In one embodiment, the base has two pairs of holes defined in communication with the notched receptacle.

In one embodiment, each L-shaped engagement block further has a rotation limiting member formed in the second portion of the bottom member and being toward the first end portion of the bottom member.

In one embodiment, each L-shaped engagement block also has a through hole defined in the second portion of the bottom member such that the through hole is coincident with the pivotal axis.

In one embodiment, each engagement claw of each L-shaped engagement block has an outer surface extending gradually close to the imaginary axis toward the first direction, an inner surface facing the receiving space, an inclined top surface at a first junction between the outer surface and the inner surface, an engagement concave at a second junction between the outer surface and the inner surface, and a vertex located between the inclined top surface and the engagement concave, where an included angle between an extending direction of the inclined top surface and the imaginary axis is not equal to 90 degrees, and the engagement concaves of the engagement claws are opened substantially toward opposite directions for allowing the pillars of the drive member to enter the engagement concaves through openings of the engagement concaves. In one embodiment, the engagement concave of each engagement block of the transmission unit has a recess and a limiting surface located between the recess and the vertex and inclined substantially from the vertex toward the inclined top surface.

In one embodiment, the first end portion and the second end portion of the bottom member of each L-shaped engagement block have a first width, W1, and a second width, W2, respectively, where the first width W1 is narrower than the second width W2.

In one embodiment, the notched receptacle has two openings defined symmetrically in two opposite sides of the base, and two grooves defined recessively in the base and the shaft and being in communication with the two openings, respectively, and wherein each groove has a width, N1, and each opening has a width, N2, where the width N1 of each groove is narrower than the width N2 of each opening. In one embodiment, the two grooves are formed in the form of one groove.

In one embodiment, when the two L-shaped engagement blocks are received in the notched receptacle, each L-shaped engagement block is pivotally attached to the base by a pin inserted through the through hole and a respective pair of holes of the base, such that the second end portion of the bottom member of each L-shaped engagement block is received in a respective opening and the first end portion of the bottom member of each L-shaped engagement block is received in a respective groove.

In one embodiment, the hook of each L-shaped engagement block is a T-shaped hook.

In addition, the engagement structure also includes a holding member engaged with the hook of the bottom member of each L-shaped engagement block.

In one embodiment, the holding member comprises an elastic ring, a magnet, or a spring. The elastic ring may be formed of an elastic material comprising plastic, or silicon.

In one embodiment, the elastic ring comprises two ear rings formed on the two opposite sides of the elastic ring.

Further, the transmission device comprises a transmission unit also includes a sleeve, a gear member and an elastic member.

The sleeve has a main body, an axial hole defined through the main body along the imaginary axis, and at least one guiding groove formed on the main body and communicated with the axial hole, the shaft of the transmission unit being disposed in the axial hole and capable of rotating and moving axially, and the at least one protrusion of the shaft being movably retained in the at least one guiding groove. The sleeve may further comprise two pillars protruding from the main body.

In one embodiment, the at least one guiding groove of the sleeve is formed in a shape of rectangle. In another embodiment, the at least one guiding groove of the sleeve has a bottom side substantially perpendicular to the imaginary axis, and two lateral sides respectively extending from two ends of the bottom side toward to the first direction, and a top side connected between the two lateral sides, and wherein the top side has a sloped portion and an extending portion parallel to the bottom side.

In addition, the gear member adapted for engaging with the photosensitive drum includes a housing defined along the imaginary axis for receiving the main body of the sleeve so that the sleeve is coupled with the gear member unrotatably around the imaginary axis.

In one embodiment, the gear member has a top portion, a gear portion extending from the top portion along the imaginary axis toward the second direction, and a bottom portion extending from the gear portion along the imaginary axis) toward the second direction, where the top portion of the gear member has at least one slot.

Further, the elastic member is disposed in the axial hole of the sleeve and has two ends abutted against a bottom wall of the gear member and the second end of the shaft of the transmission unit, respectively.

In another aspect of the invention, the transmission device for a photosensitive drum includes a transmission unit. The transmission unit, in one embodiment, comprises:

a shaft extending along an imaginary axis and having a first end facing toward a first direction, a second end facing toward a second direction opposite to the first direction, and at least one protrusion extending along a radial direction of the shaft; and an engagement structure comprising:

a base extending from the first end of the shaft;

a notched receptacle defined in the base;

two L-shaped engagement blocks, each L-shaped engagement block having a bottom member and an engagement claw, the bottom member having a first end portion defining a hook and an opposite, second end portion, and the engagement claw extending vertically from the second end portion of the bottom member, wherein the two L-shaped engagement blocks are pivotally received in two opposite sides of the notched receptacle, respectively, such that each L-shaped engagement block is rotatable around a pivotal axis at the second end portion of the bottom member, the pivotal axis being perpendicular to the imaginary axis, the first end portion of the bottom member is toward the imaginary axis and the engagement claw is helically toward the first direction in a normal state, and wherein the two L-shaped engagement blocks defines a receiving space therebetween; and a holding member engaged with the hook of the bottom member of each L-shaped engagement block.

The transmission device may also have a sleeve, a gear member and an elastic member, as disclosed above.

In yet another aspect, the invention relates to a transmission unit. In one embodiment, the transmission unit includes a shaft rotatable about an axis and movable in the direction of the axis, and an engagement structure being co-axial with the shaft and having at least two engaging blocks. The engaging blocks extend from the edge portion of the engagement structure in a direction parallel to the axis and are rotatable toward the axis or outward the axis.

In one embodiment, the engagement structure comprises a base extending from a first end of the shaft, and at least two notched receptacles defined in the edge portion of the base. Each engagement block is pivotally retained in a respective notched receptacle such that each engagement block is rotatable around a pivotal axis that is perpendicular to the axis. As a result, the at least two engagement blocks define a receiving space therebetween for receiving the drive member.

In one embodiment, each engagement block has a bottom member, an engagement claw vertically extending from the bottom member, and a through hole defined in the junction portion of the bottom member and an engagement claw, such that the through hole is coincident with the pivotal axis.

In one embodiment, each engagement block is pivotally attached to the base by a pin inserted through the through hole.

The transmission unit is usable in a transmission device attachable to a cylindrical drum usable with a main assembly of an electronic image forming apparatus. The transmission device is an end member. The main assembly includes a driving member to be driven by a motor, having a rotational force applying portion. The transmission device (i.e., the end member) has a cylindrical bearing member configured such that a transmission unit is operably co-axial with an axis of the bearing member and retained by the bearing member. The engagement structure is engageable with the driving member to receive a rotational force from the rotational force applying portion of the driving member for rotating the cylindrical drum. The rotational force is transmitted in the order of the engagement structure, the shaft, and the bearing member.

As a result, the transmission device for a photosensitive drum provided by the present invention is simpler in structure than the conventional ones, where the engagement concaves of the engagement structure can be engaged with the pillars of the drive member of the electronic image forming apparatus so that the transmission unit can be driven to rotate. Besides, when the user is going to connect the transmission device with the drive member of the electronic image forming apparatus or separate the transmission device from the drive member of the electronic imaging device, the engagement structure will be pushed by the drive member of the electronic image forming apparatus so that the transmission unit will move axially along the sleeve. At the same time, the protrusion of the shaft will be guided by the guiding grooves of the sleeve so that the transmission unit will rotate. As a result, the transmission unit can be connected with the drive member of the electronic image forming apparatus firmly and separated from the drive member smoothly by moving and rotating at the same time.

These and other aspects of the present invention will become apparent from the following description of the embodiment taken in conjunction with the following drawings, although variations and modifications therein may be affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
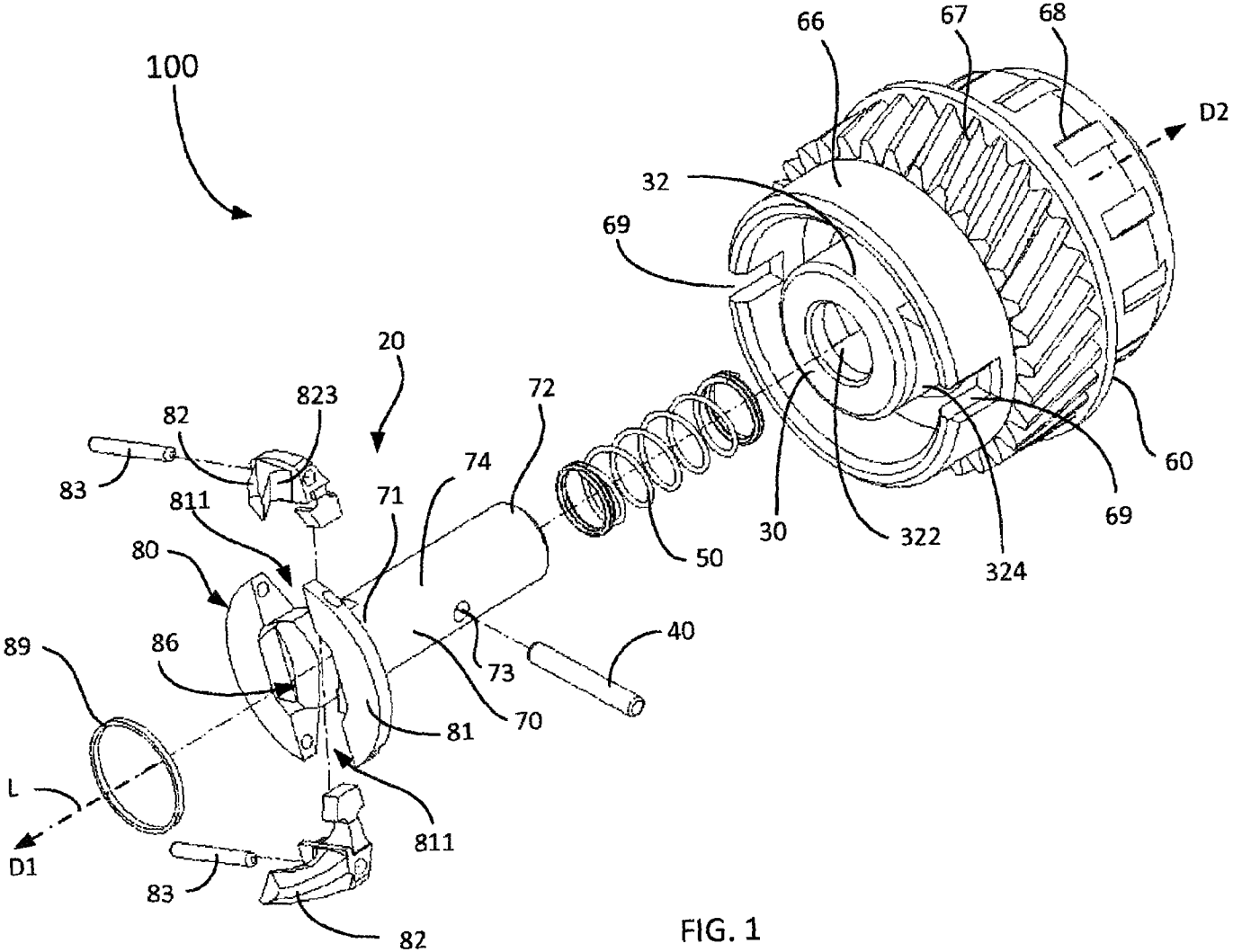
FIG. 1 shows an exploded perspective view of a transmission device for a photosensitive drum according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this invention will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the FIGS. It will be understood that relative terms are intended to encompass different orientations of the device in addition to the orientation shown in the FIGS. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

The description is now made as to the embodiments of the present invention in conjunction with the accompanying drawings. In accordance with the purposes of this invention, as embodied and broadly described herein, this invention relates to a transmission device for a photosensitive drum mounted in electronic imaging devices, such as printers, copy machines, and so on.

Figure 2:
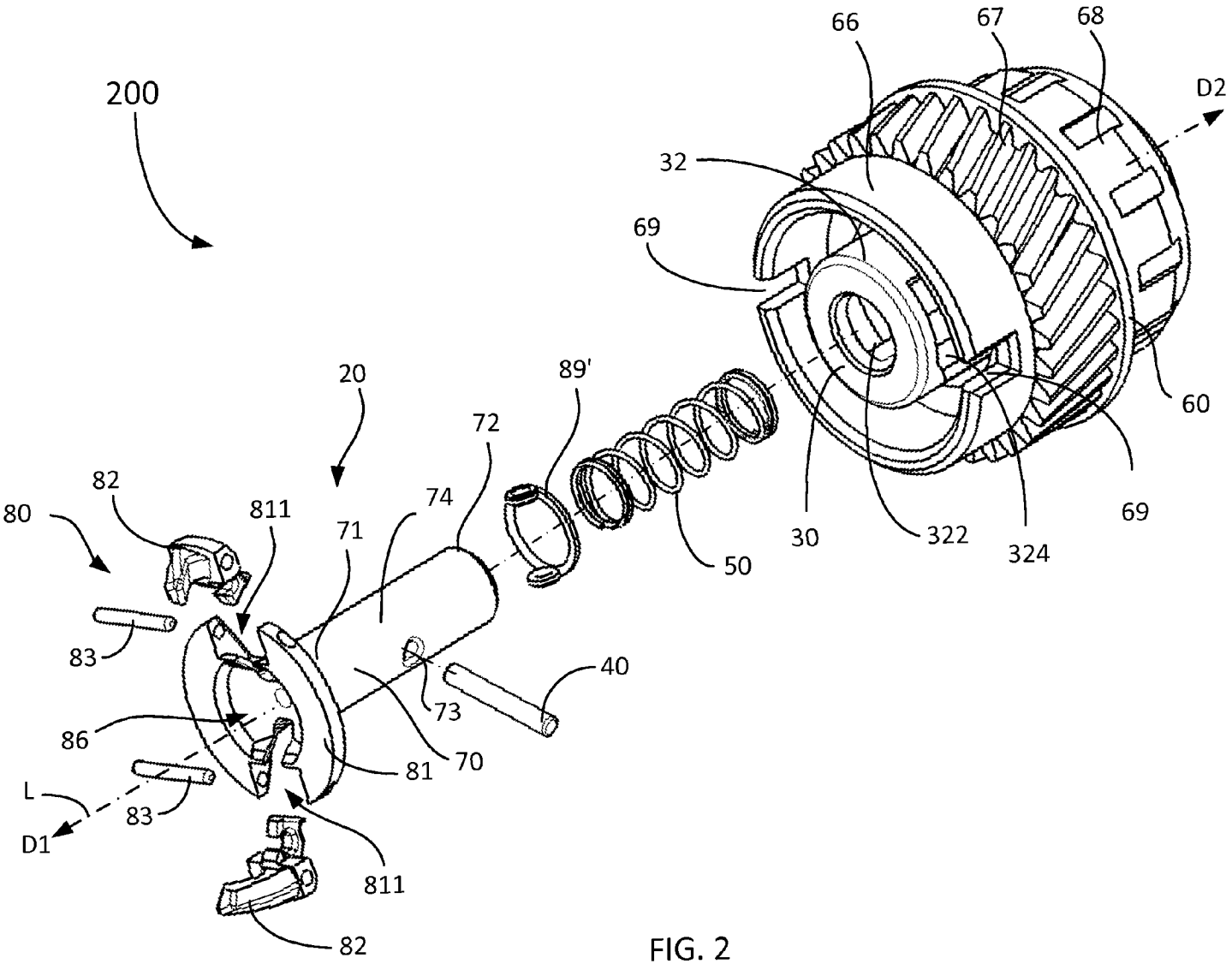
FIG. 2 shows an exploded perspective view of a transmission device for a photosensitive drum according to another embodiment of the present invention.

Referring to FIG. 1, a transmission device 100 for a photosensitive drum, which is provided by a first embodiment of the present invention, comprises a transmission unit 20, a sleeve 30, an elastic member 50, and a gear member 60. FIG. 2 shows another embodiment of a transmission device 200 for a photosensitive drum, which is essentially the same the transmission device 100 shown in FIG. 1, except that the elastic holding member 89 utilized in the transmission device 100 is different from that (89') of the transmission device 200.

As shown in FIGS. 1, 2 and 4-10, the transmission unit 20 comprises a shaft 70 and an engagement structure 80. The shaft 70 comprises a cylindrical shaft body 74 and at least one protrusion 75 extending along a radial direction of the cylindrical shaft body 74. The shaft body 74 is an elongated element extending along an imaginary axis L and provided with a first end 71 facing toward a first direction D1, a second end 72 facing toward a second direction D2 opposite to the first direction D1, and an opening 73 penetrating through the main portion of the shaft body 74 along its radial direction. In one embodiment, a pin 40 is inserted into the opening 73 when assembled, where the protrusion 75 is a part of the pin 40 sticking out of the opening 73.

The engagement structure 80 comprises a base 81 extending from the first end 71 of the shaft 70 integrally, and a notched receptacle 811 defined in the base 81. The base 81 has two pairs of holes 812 defined in communication with the notched receptacle 811.

Figure 4:
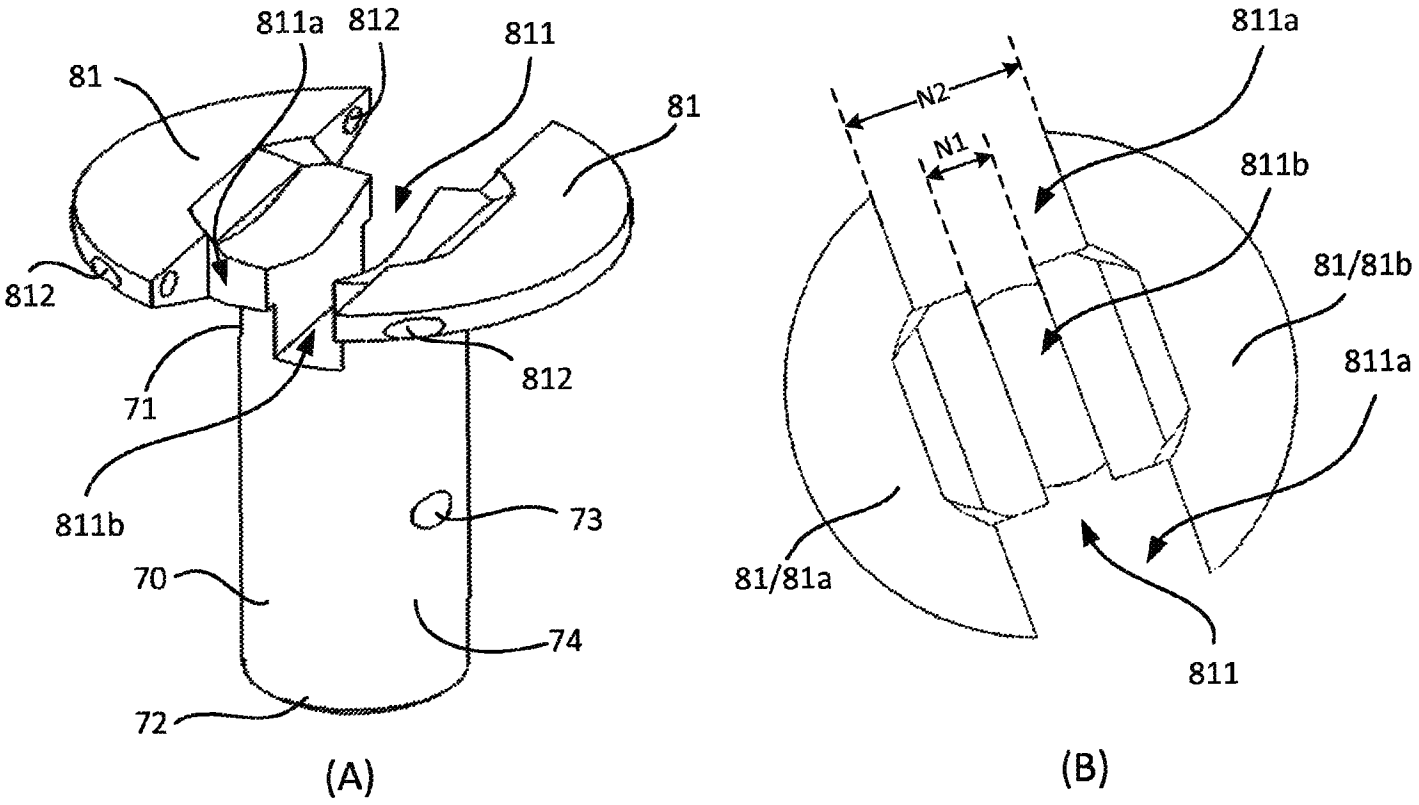
FIG. 4 shows partially a transmission unit utilized in a transmission device according to one embodiment of the present invention, (A) a perspective view, and (B) a top view.
Figure 7:
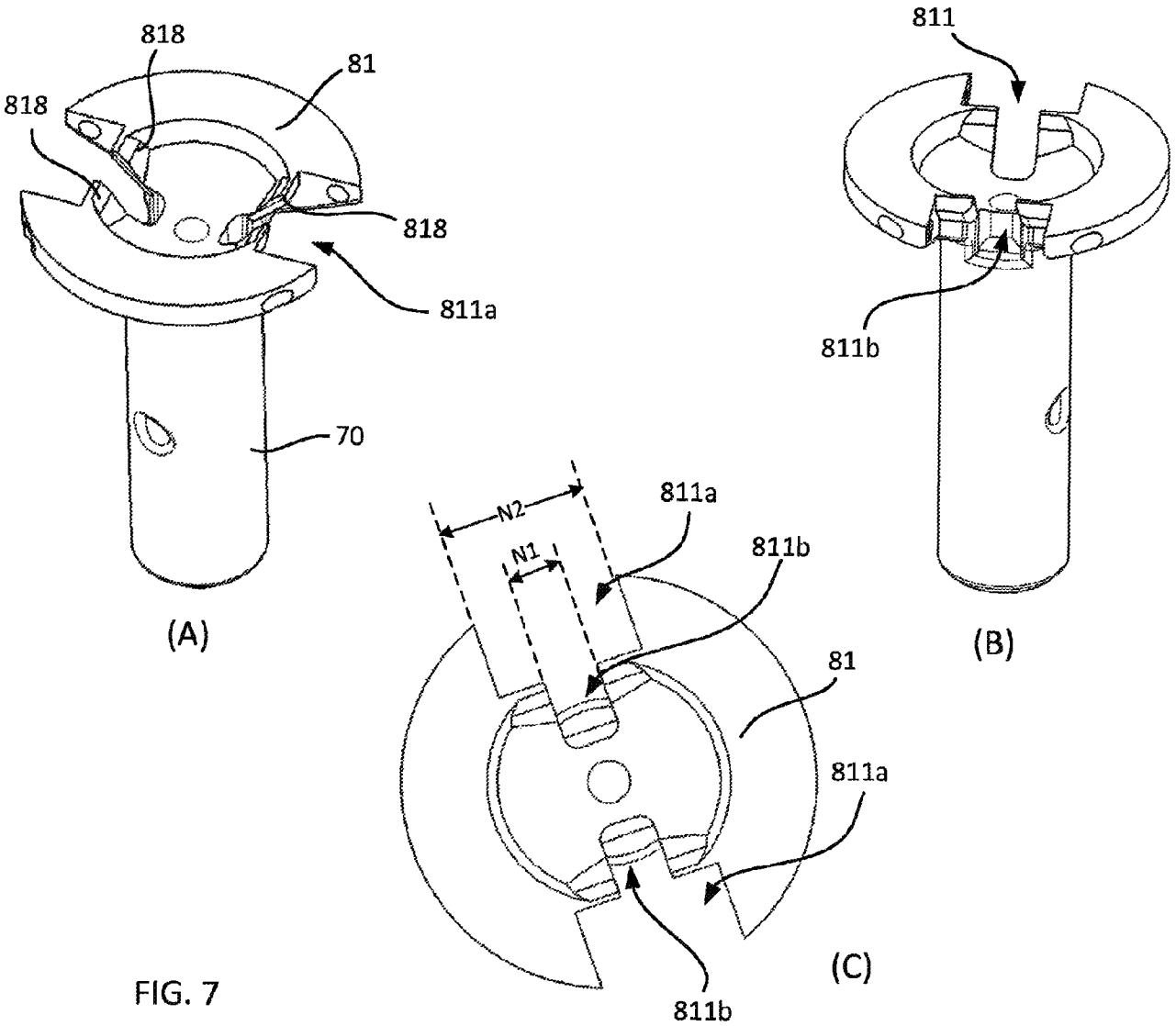
FIG. 7 shows partially a transmission unit utilized in a transmission device according to another embodiment of the present invention, (A) a perspective view, (B) another perspective view, and (C) a top view.

As shown in FIGS. 4 and 7, the notched receptacle 811 has two openings 811*a* defined symmetrically in two opposite sides of the base 81, and two grooves 811*b*, as shown in FIG. 7, defined recessively in the base 81 and the first end portion 71 of the shaft 70 and being in communication with the two openings 811*a*, respectively. Each groove 811*b* has a width, N1, and each opening 811*a* has a width, N2, where the width N1 of each groove 811*b* is narrower than the width N2 of each opening 811*a*. In one embodiment, as shown in FIG. 7, the notched receptacle 811 is defined with barriers 818 that are adapted to prevent the L-shaped engagement block 82 from over-rotating toward the imaginary axis L when the transmission unit 20 is engaging or disengaging with a drive member 90. In addition, the two grooves 811*b* may be formed in the form of one groove, which separates the base 811 into two portions 81*a* and 81*b*, as shown in FIG. 4.

The engagement structure 80 also comprises two L-shaped engagement blocks 82. Each L-shaped engagement block 82 has a bottom member 829 and an engagement claw 820. The bottom member 829 has a first end portion 829*a* defining a hook 826 and an opposite, second end portion 829*b*. The engagement claw 820 extends vertically from the second end portion 829*b* of the bottom member 829. The two L-shaped engagement blocks 82 are pivotally received in two opposite sides of the notched receptacle 811, respectively, such that each L-shaped engagement block 82 is rotatable around a pivotal axis at the second end portion 829*b* of the bottom member 829, the pivotal axis being perpendicular to the imaginary axis L, the first end portion 829*a* of the bottom member 829 is toward the imaginary axis L and the engagement claw 820 is helically toward the first direction D1 in a normal state. The two L-shaped engagement blocks 82 defines a receiving space 86 therebetween for receiving the drive member 90.

Figure 5:
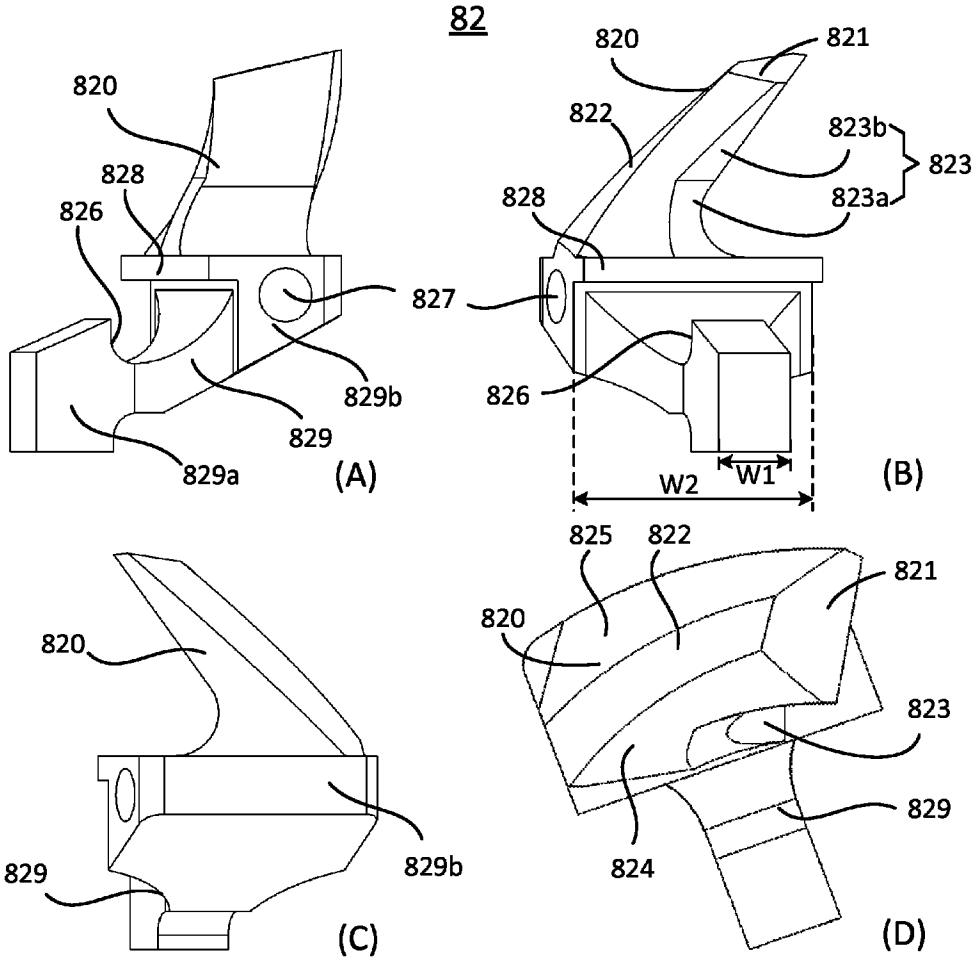
FIG. 5 shows an L-shaped engagement block of a transmission unit utilized in a transmission device according to one embodiment of the present invention, (A)-(D) different perspective views.
Figure 8:
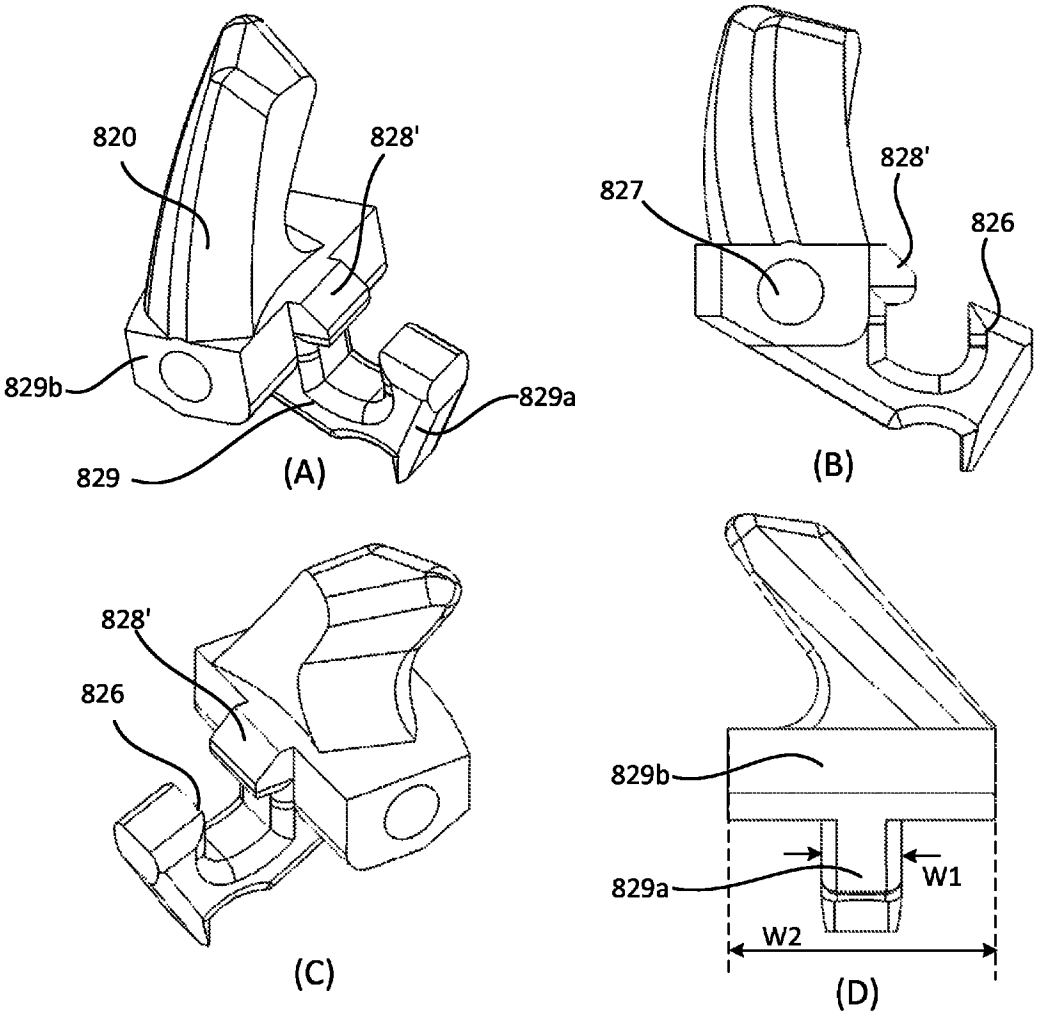
FIG. 8 shows an L-shaped engagement block of a transmission unit utilized in a transmission device according to another embodiment of the present invention, (A)-(D) different perspective views.

As shown in FIGS. 5 and 8, each engagement block 82 has an outer surface 825 extending gradually close to the imaginary axis L toward the first direction D1, an inner surface 824 facing the receiving space 86, an inclined top surface 822 at a junction between the outer surface 825 and the inner surface 824, an engagement concave 823 at another junction between the outer surface 825 and the inner surface 824, and a vertex 821 located between the inclined top surface 822 and the engagement concave 823. The included angle between the extending direction of the inclined top surface 822 and the imaginary axis L is about 30 to 80 degrees. The engagement concaves 823 of the engagement blocks 82 are opened substantially toward opposite directions for allowing the pillars 92 of the drive member 90 to enter the engagement concaves 823 through openings of the engagement concaves 823. Each engagement concave 823 has an arched recess 823*a* and a limiting surface 823*b* located between the recess 823*a* and the vertex 821 and substantially inclined from the vertex 821 toward the inclined top surface 822. The engagement concaves 823 of the engagement blocks 82 are opened substantially toward opposite directions.

As shown in FIGS. 5 and 8, the first end portion 829*a* and the second end portion of the bottom member 829 of each L-shaped engagement block 82 have a first width, W1, and a second width, W2, respectively. The first width W1 is narrower than the second width W2.

In certain embodiments, the hook 826 of each L-shaped engagement block 82 is a T-shaped hook. In addition, each L-shaped engagement block 82 also has a through hole 827 defined in the second portion 829*b* of the bottom member 829, as shown in FIGS. 5 and 8. The through hole 827 is coincident with the pivotal axis.

Further, each L-shaped engagement block 82 has a rotation limiting member 828 formed in the second portion 829*b* of the bottom member 829 and being toward the first end portion 829*a* of the bottom member 829. In one embodiment, as shown in FIG. 5, the rotation limiting member 828 extends from one side to the other side the second portion 829*b* of the bottom member 829, and has the same width (W2) as the second portion 829*b* of the bottom member 829. However, in another embodiment, as shown in FIG. 8, the rotation limiting member 828' extends from the middle of the second portion 829*b* of the bottom member 829, and has a width that is essentially the same as that (W1) of the first portion 829*a* of the bottom member 829, and is narrower than that (W2) of the second portion 829*b* of the bottom member 829.

Figure 3:
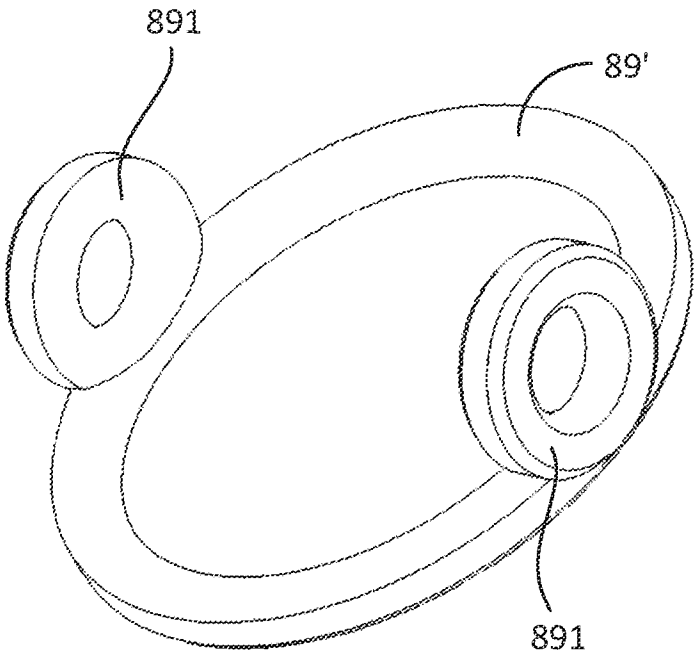
FIG. 3 shows a perspective view of a holding member utilized in a transmission device according to two embodiments (A) and (B) of the present invention.
Figure 3:
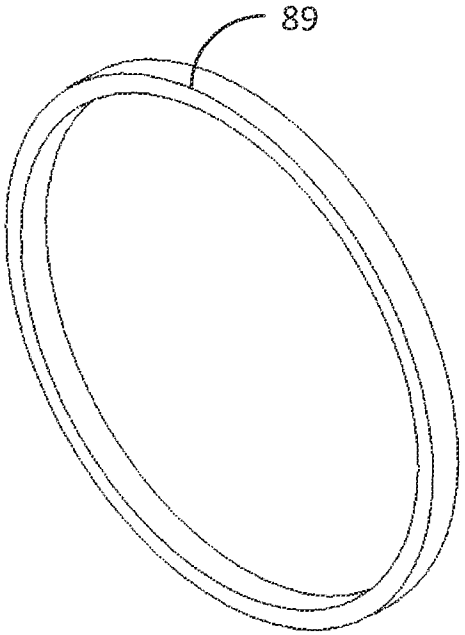

Moreover, the engagement structure 80 also includes a holding member 89 engaged with the hook 826 of the bottom member 829 of each L-shaped engagement block 82. The holding member 89 can be an elastic ring, a magnet, or a spring. In the embodiment, shown in FIG. 3A, the holding member is an elastic ring 89. The elastic ring 89 may be formed of an elastic material comprising plastic, or silicon. In this exemplary embodiment, the hooks 826 of the bottom members 825 of the two L-shaped engagement blocks 82 are hooked by the elastic ring 89. In another embodiment, as shown in FIG. 2B, the elastic ring 89' comprises two ear rings 891 formed on the two opposite sides of the elastic ring 89'. As such, the hooks 826 of the bottom members 825 of the two L-shaped engagement blocks 82 are hooked by the ear rings 891 of the elastic ring 89'. Alternatively, a spring may be used to connect the hooks 826 of the bottom members 825 of the two L-shaped engagement blocks 82. In addition, a magnetic force may be utilized to force the two L-shaped engagement blocks 82 to be in the normal state.

Figure 6:
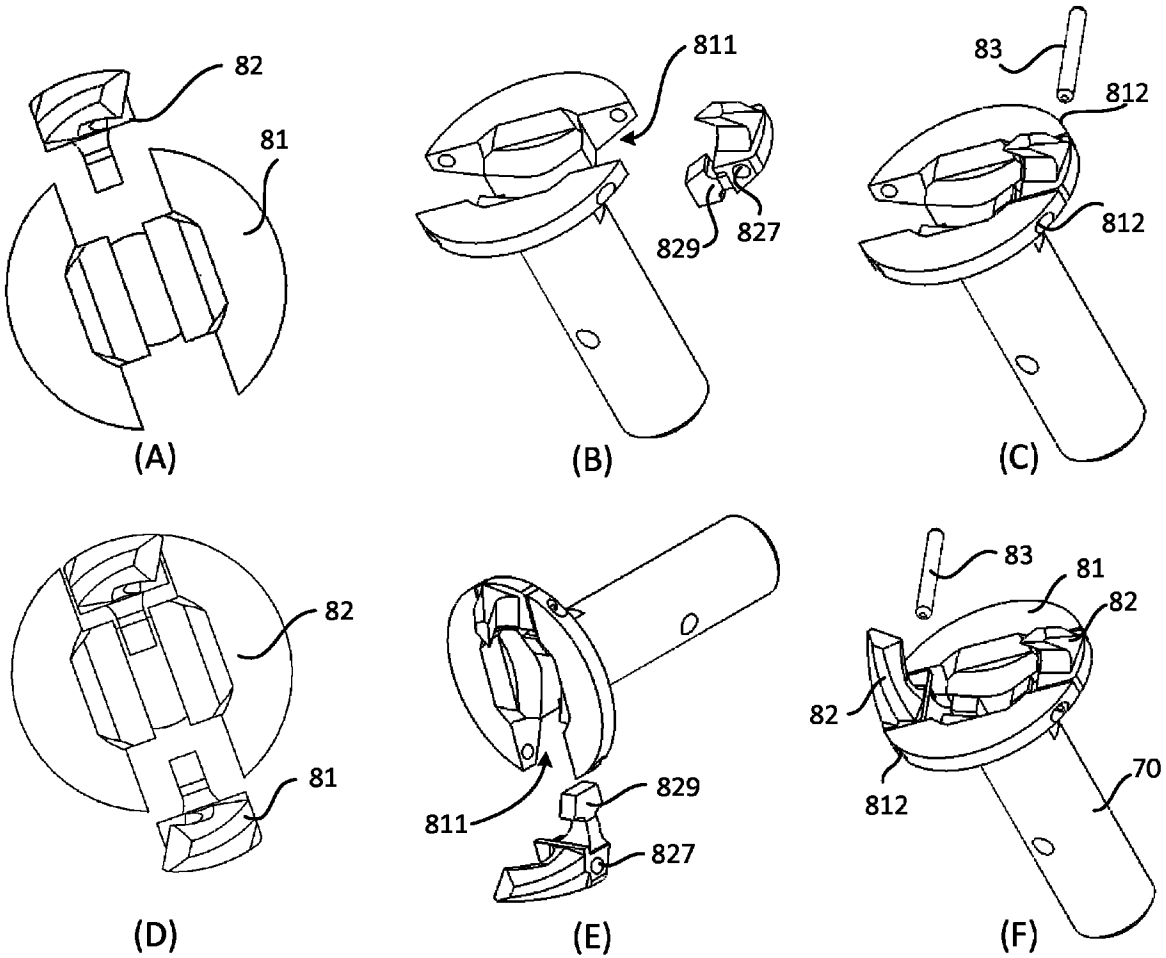
FIG. 6 shows an assembly process (A)-(F) of a transmission unit utilized in a transmission device according to one embodiment of the present invention.
Figure 9:
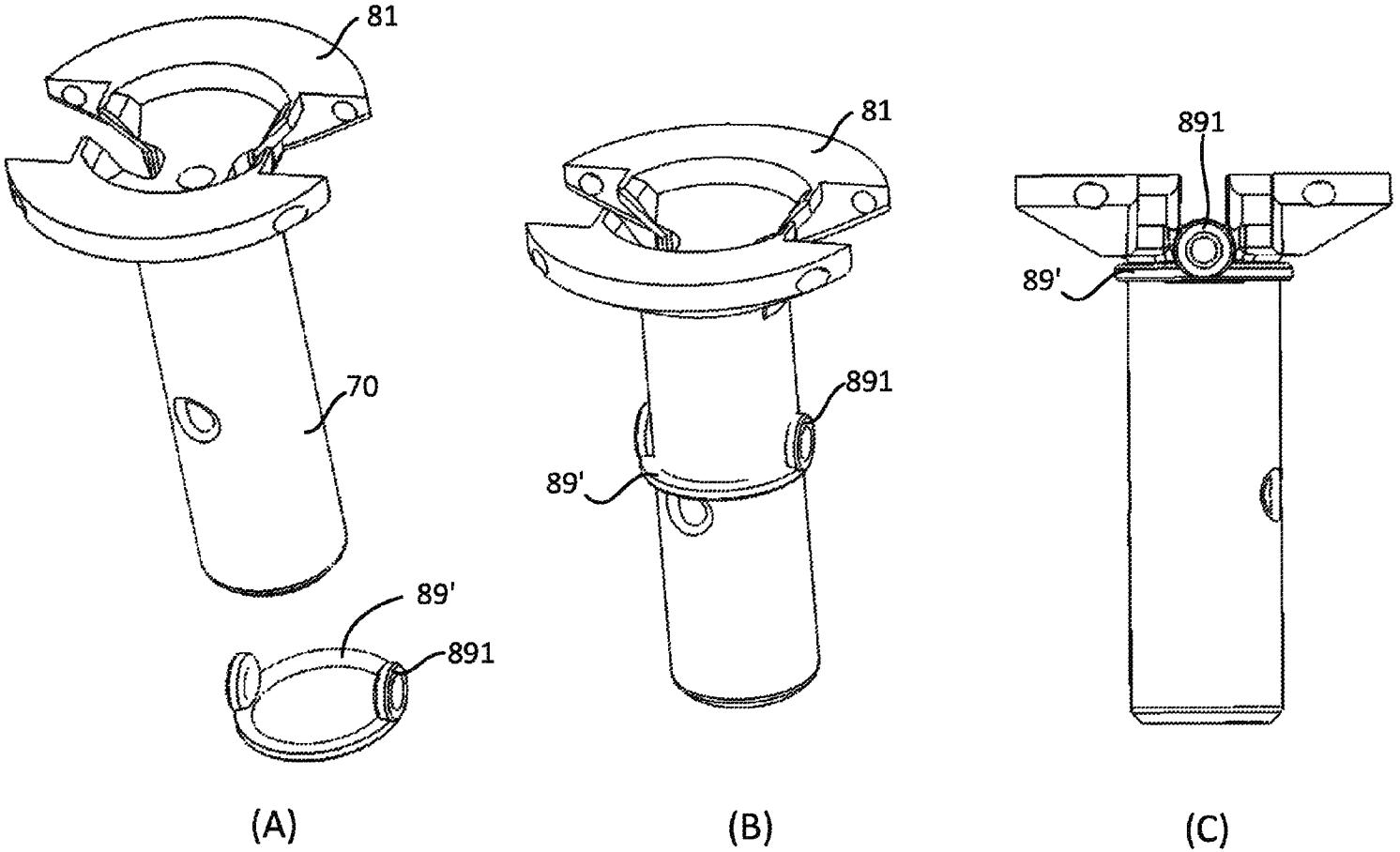
FIGS. 9 and 10 show an assembly process (9A-9C and 10A-10F of a transmission unit utilized in a transmission device according to another embodiment of the present invention.
Figure 10:
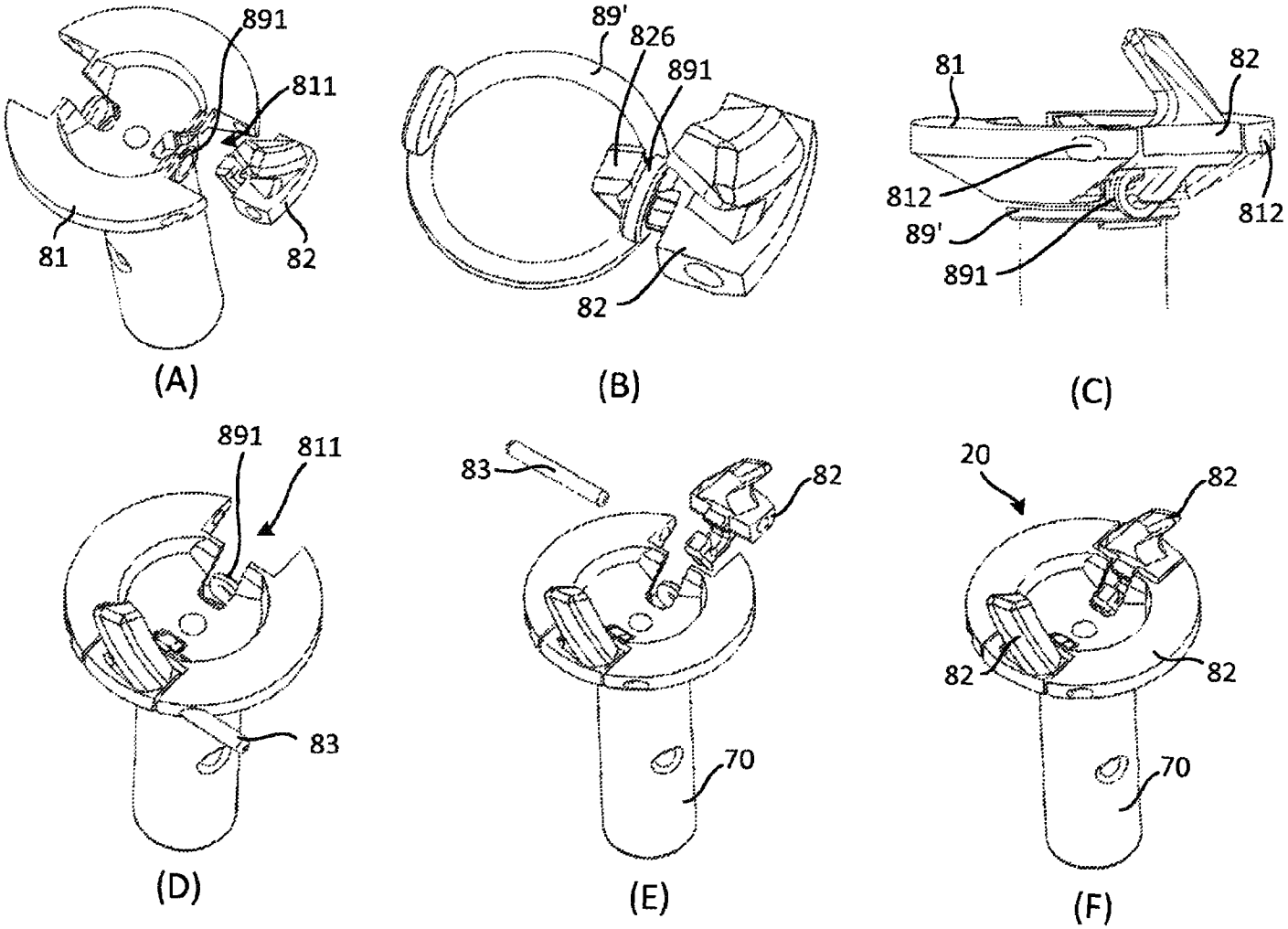

According to the invention, the assembly process of the transmission unit 20 is very simple. As shown in FIGS. 6, 9 and 10, the two L-shaped engagement blocks 82 are received in the notched receptacle 811 and pivotally secured to the base 81 by two pins 83. For example, each L-shaped engagement block 82 is placed into a respective opening 811*a* and groove 811*b*, a pin 83 is inserted through the through hole 827 of the L-shaped engagement block 82 and a respective pair of holes 812 of the base 81 to pivotally attach the L-shaped engagement block 82 to the base 81, and the holding member (elastic ring) 89 is then placed to hook the hooks 826 of the two L-shaped engagement blocks 82, as shown in FIG. 6. Alternatively, as shown in FIGS. 9 and 10, first, the shaft 70 is inserted in the elastic ring 89' to position the ear rings 891 in the grooves 811*b*. Then, each L-shaped engagement block 82 is placed into a respective opening 811*a* and groove 811*b*, the hooks 826 of the two L-shaped engagement blocks 82 are inserted into the ear rings 891 of the elastic ring 89', and a pin 83 is inserted through the through hole 827 of the L-shaped engagement block 82 and a respective pair of holes 812 of the base 81 to pivotally attach the L-shaped engagement block 82 to the base 81.

As such, the second end portion 829*b* of the bottom member 829 of each L-shaped engagement block 82 is received in the respective opening 811*a*, the first end portion 829*a* of the bottom member 829 of each L-shaped engagement block 82 is received in the respective groove 811*b*, and each L-shaped engagement block 82 is rotatable around its pivotal axis, i.e., its corresponding pin 83. The L-shaped engagement blocks 82 extends helically from two opposite sides of the base 8, respectively, which are about the upside and the downside of the base 81 shown in FIGS. 1 and 2, away from the imaginary axis L and toward the first direction D1. The pulling force exerts on the hooks 826 of the two L-shaped engagement blocks 82 by the elastic ring 89 (or 89') makes the L-shaped engagement blocks 82 in the normal state.

Furthermore, the transmission device comprises a transmission unit 20 also includes a sleeve 30, a gear member 60 and an elastic member 50.

Figure 11:
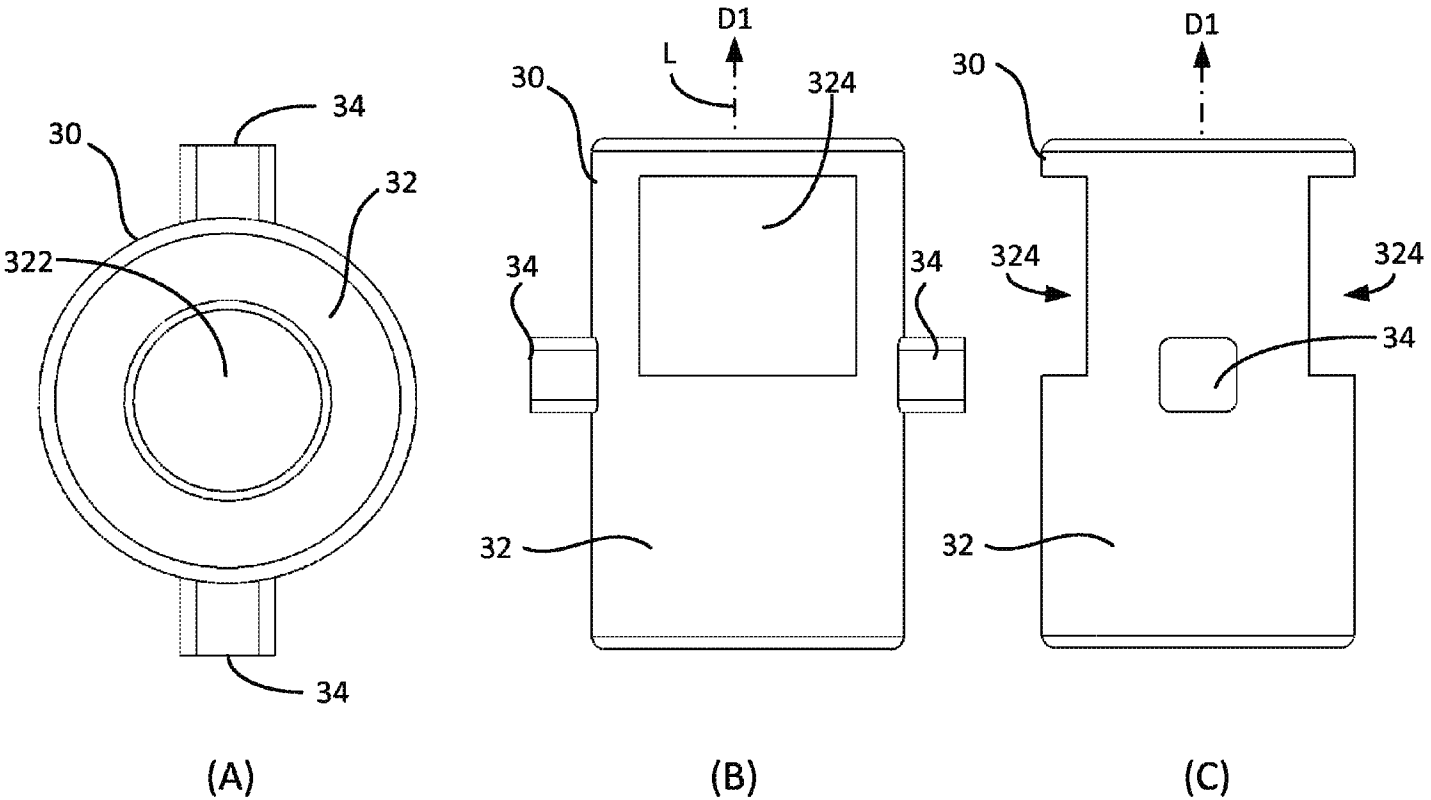
FIG. 11 shows a sleeve utilized in a transmission device for a photosensitive drum according to one embodiment of the present invention, (A) a top view, (B) a cross-section view, and (C) another cross-section view.
Figure 12:
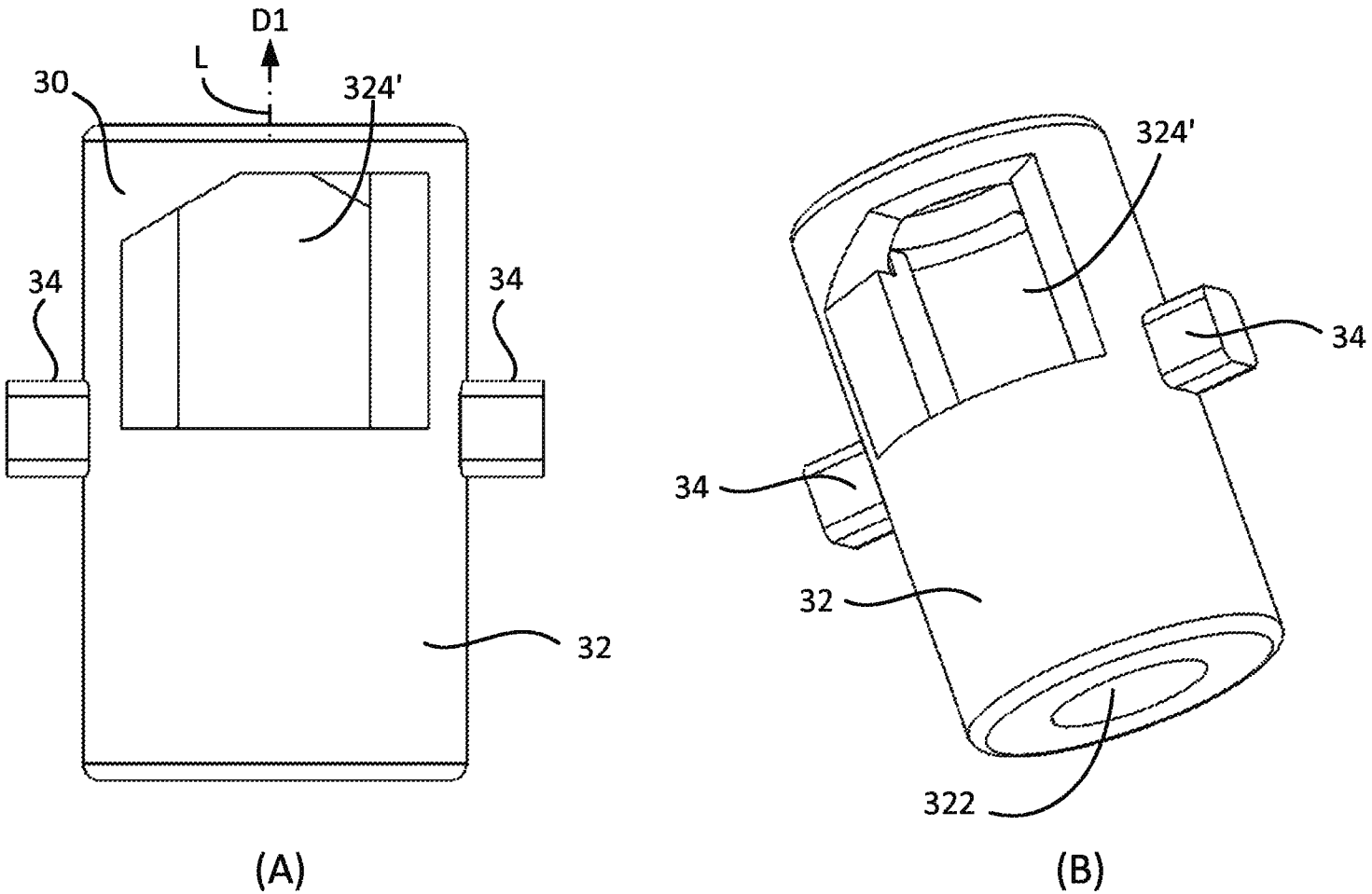
FIG. 12 shows a sleeve utilized in a transmission device for a photosensitive drum according to one embodiment of the present invention, (A) a cross-section view, and (B) a perspective view.

Referring to FIGS. 1, 2, 11 and 12, and particularly to FIGS. 11 and 12, the sleeve 30 comprises a main body 32, an axial hole 322 defined through the main body 32 along the imaginary axis L, two guiding grooves 324 formed on the main body 32, communicated with the axial hole 322, and two pillars 34 protruding from the main body 32. Only one of the guiding grooves 324 is shown in the figures, and the other groove 324 is located opposite to the groove 324 shown in the figures.

As shown in FIG. 11, each guiding groove 324 is in a shape of rectangle, and has a bottom side substantially perpendicular to the imaginary axis L, two lateral sides respectively extending from two ends of the bottom side toward to the first direction D1, and a top side connected between the two lateral sides and parallel to the bottom side. As shown in FIG. 12, the top side has a sloped portion and an extending portion parallel to the bottom side. It should be appreciated to one skilled in the art that other types of the sleeve can also be utilized to practice the invention.

According to the invention, as assembled, the shaft 70 of the transmission unit 20 is disposed in the axial hole 322 and capable of rotating and moving axially. The pin 40 is inserted into the opening 73 of the transmission unit 20 in such a way that the shaft 70 of the transmission unit 20 has two protrusions 75 extending along the shaft's radial direction, as shown in FIG. 2B. The protrusions 75, which are formed by the two parts of the pin 40 that protrude out of the opening 73, are movably received in the guiding grooves 324, respectively.

It should be appreciated to one skilled in the art that the opening 73 of the transmission unit 20 can also be provided without penetrating the shaft 70. For example, the shaft 70 of the transmission unit 20 may have only one protrusion 75 and the sleeve 30 only needs to be provided with one guiding groove 324. Besides, the protrusion 75 of the shaft 70 is not limited to be formed by the pin 40 inserted into the opening 73. For example, the protrusion 75 can be protruded from the shaft body 74 integrally; in that condition, the guiding groove 324 should have an open end so that the protrusion 75 can enter the guiding groove 324 through its open end, and the open end of the guiding groove 324 should be capped by an annular cap provided at, but not limited to, the shaft 70.

Figure 13:
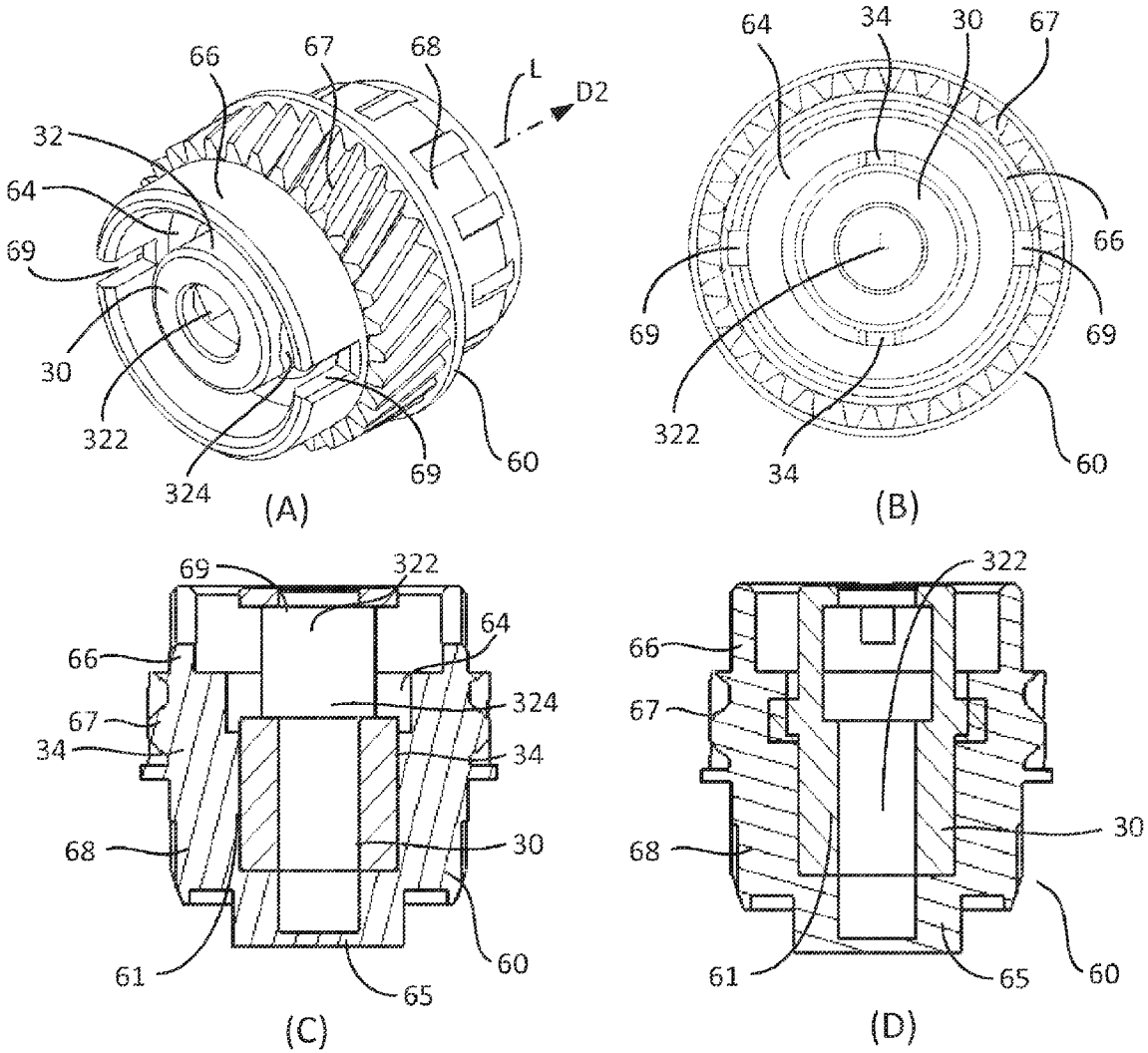
FIG. 13 shows a gear member and a sleeve assembled in the gear member utilized in a transmission device for a photosensitive drum according to one embodiment of the present invention, (A) a perspective view, (B) a top view, (C) a cross-section view, and (D) another cross-section view.
Figure 15:
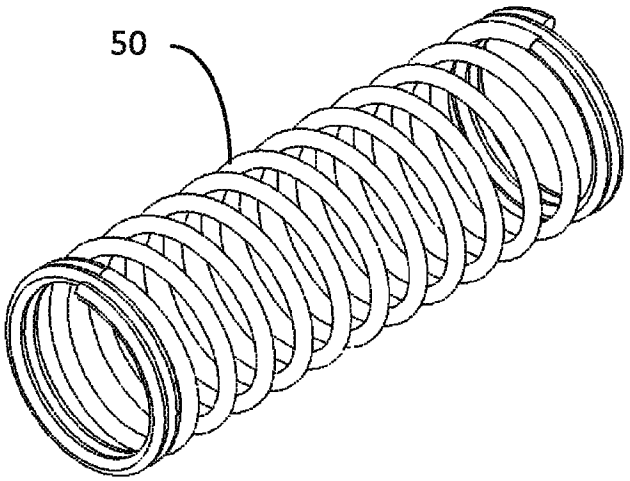
FIG. 15 shows an elastic member utilized in a transmission device for a photosensitive drum according to one embodiment of the present invention.
Figure 14:
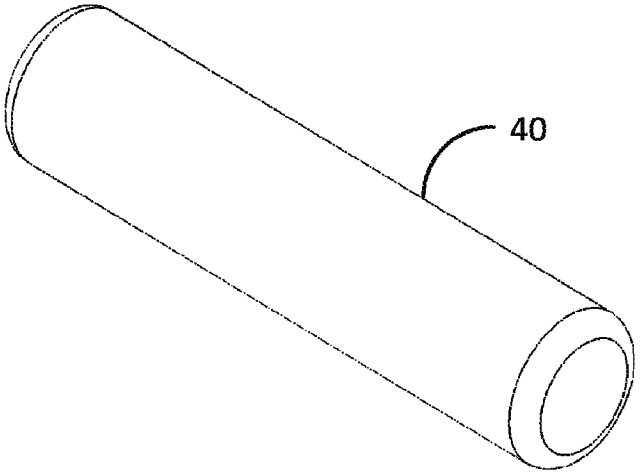
FIG. 14 shows a pin utilized in a transmission device for a photosensitive drum according to one embodiment of the present invention.

Referring to FIGS. 1, 2 and 13, the gear member 60 is adapted for engaging with the photosensitive drum and has the gear member 60 has a top portion 66, a gear portion 67 extending from the top portion 66 along the imaginary axis L toward the second direction D2, a bottom portion 68 extending from the gear portion 67 along the imaginary axis L toward the second direction D2, a top wall 64 located at the side of the top portion 66, and a bottom wall 65 located at the side of the bottom portion 68. In addition, the top portion 66 of the gear member 60 may have at least one slot 69. The peripheral configuration of the gear member 60 is similar to the conventional ones. Inside the gear member 60, there is a housing 61 defined along the imaginary axis L for receiving the main body 32 of the sleeve 30 so that the sleeve 30 is coupled with the gear member 60 unrotatably around the imaginary axis L. In certain embodiments, the sleeve 30 is molded in the gear member 60.

In certain embodiments, the gear member 60 has an installation slot formed on the top wall 64, and two limiting recesses communicated with each other. The housing 61 extends along the imaginary axis L and opened on the top wall 64. The installation slot extends from the housing 61 toward the two opposite radial directions of the housing 61 and opened on the top wall 64. The limiting recesses are located adjacent to the installation slot, extending parallel to the imaginary axis L and not opened on the top wall 64. The sleeve 30 may further have two pillars 34 protruding from the main body 32. In assembly, the two pillars 34 of the sleeve 30 are inserted into the housing 61 through the installation slot, and then the sleeve 30 is turned to cause the pillars 34 to enter the limiting recesses so that the sleeve 30 is limited in the gear member 60. The details of such embodiments are disclosed in the pending U.S. patent application Ser. Nos. 13/965,856 and 14/310,615, which are hereby incorporated herein in their entireties by reference, and not repeated herein.

Figure 16:
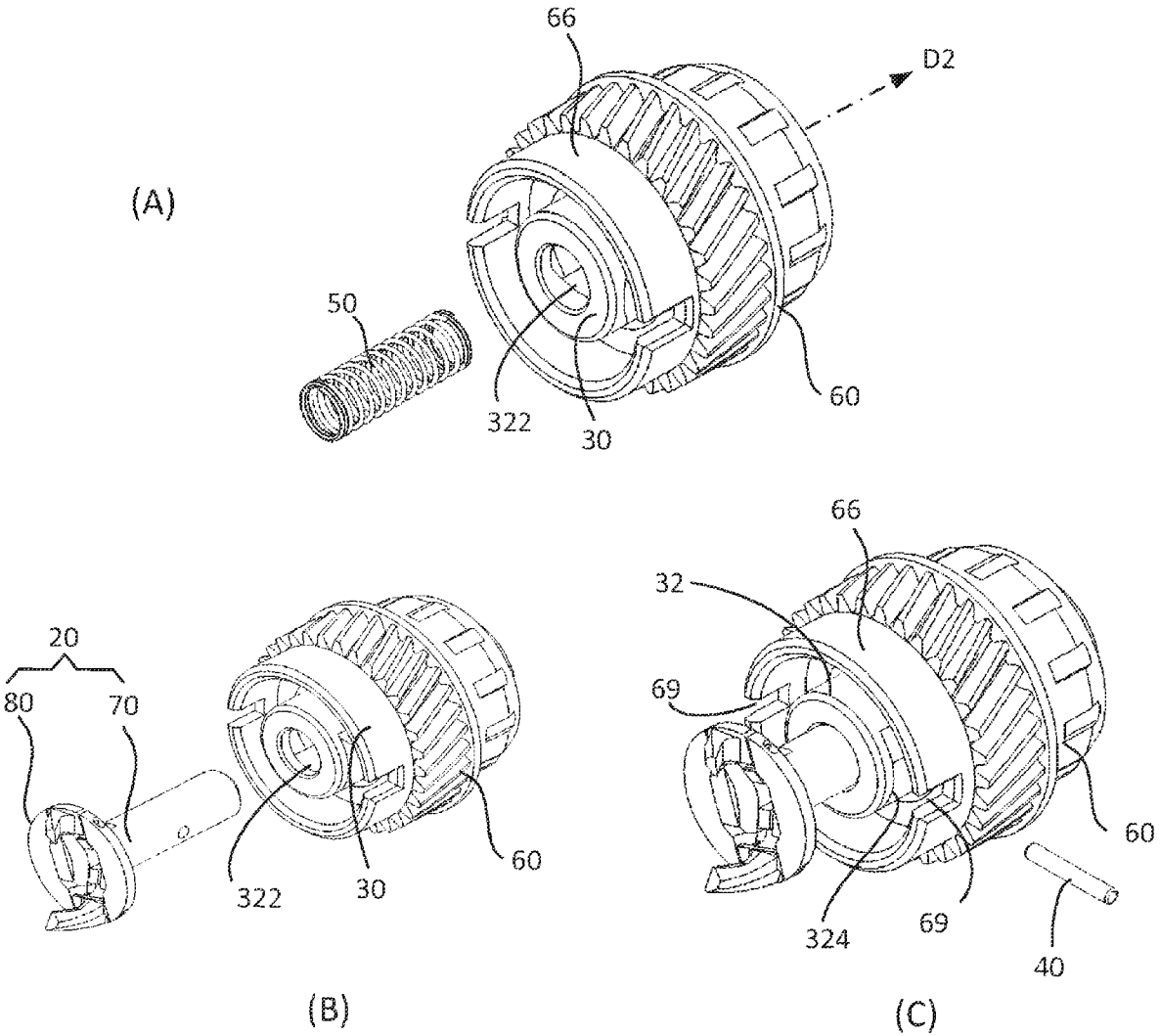
FIG. 16 shows an assembly process (A)-(C) of a transmission device for a photosensitive drum according to one embodiment of the present invention.

According to the invention, the assembly process of the transmission device is very simple. As shown in FIG. 16A, first, the elastic member 50 is disposed in the axial hole 322 of the sleeve 30. The axial hole 322 of the sleeve 30 is in communication with the housing 61 of the gear member 60. Then, the shaft 70 of the transmission unit 20 is inserted in the axial hole 322 of the sleeve 30, as shown in FIG. 16B. Next, the pin 40 is inserted into the opening 73 of the shaft 70 of the transmission unit 20 through the through slots 69 of the gear member 60 and the guiding grooves 324 of the sleeve 30, as shown in FIG. 16C. As such, the two end portions (i.e., protrusions 75) of the pin 40 are retained and moveably limited in the guiding grooves 324, and two ends of the elastic member 50 are abutted against the bottom wall 65 of the gear member 60 and the second end 72 of the shaft 70 of the transmission unit 20, respectively, so that a force generated by the elastic member 50 exerts on the second end 72 of the shaft 70 of the transmission unit 20 along the imaginary axis L, which makes the pin 40 (i.e., protrusions 75) of the shaft 70 in a position against the top side or vertex of the guiding grooves 324 of the sleeve 30 in a normal state of the transmission device.

When the transmission device 100 is used, the gear member 60 is fastened to a photosensitive drum which is adapted for installation in a toner cartridge (not shown), and the engagement structure 80 of the transmission unit 20 sticks out of an end of the toner cartridge. When the user puts the toner cartridge into a housing of an electronic image forming apparatus (not shown), the engagement structure 80 of the transmission unit 20 will be engaged with a drive member 90 (shown in FIGS. 17-23) located in the housing in such a way that a part of the drive member 90 is received in the receiving space 86 and the engagement concaves 823 are received and engaged with two pillars 92 of the drive member 90 respectively so that the photosensitive drum will be driven to rotate by the drive member 90.

Figure 17:
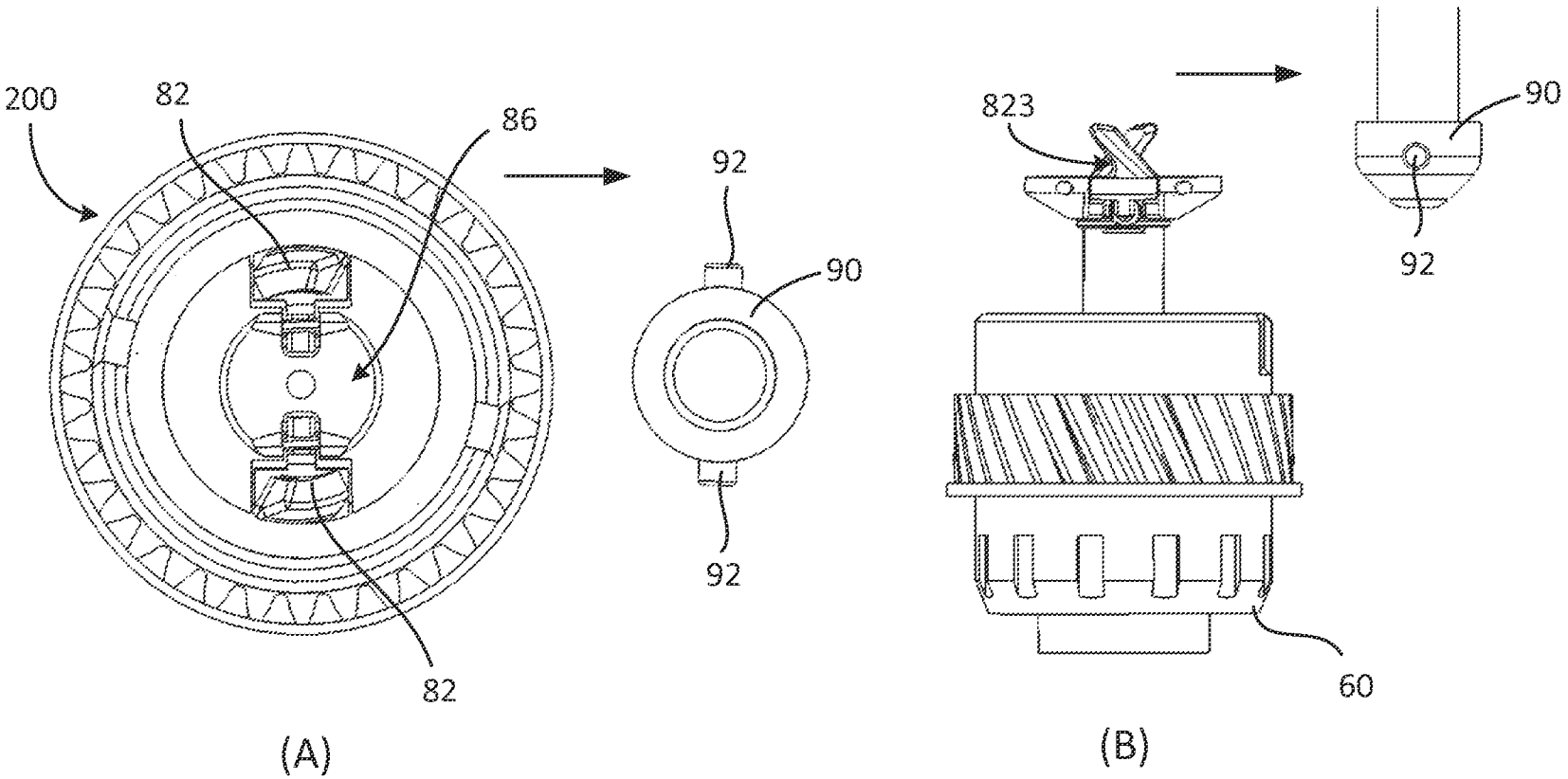
FIGS. 17-19 are views showing a process how a transmission device for a photosensitive drum is connected with a drive member according to one embodiment of the present invention.
Figure 18:
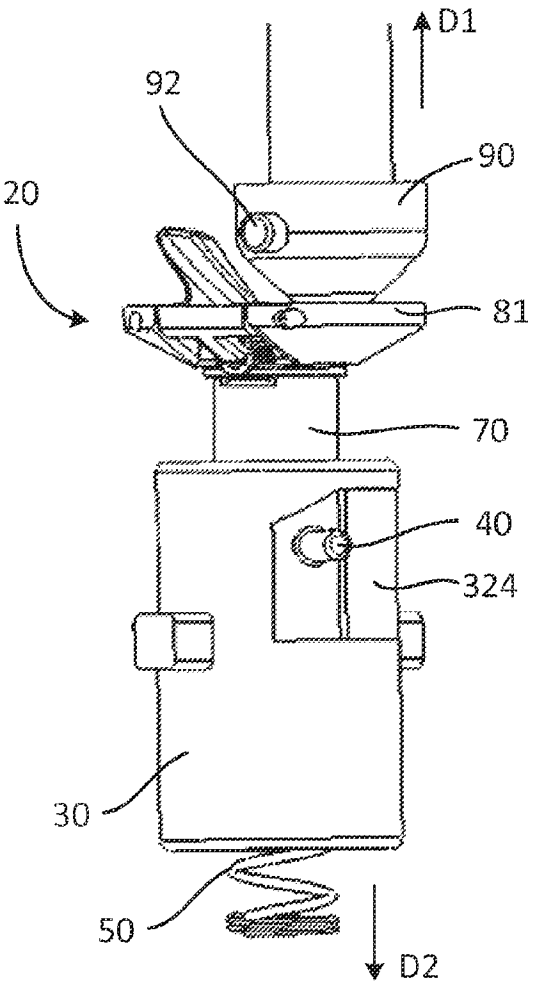
Figure 18:
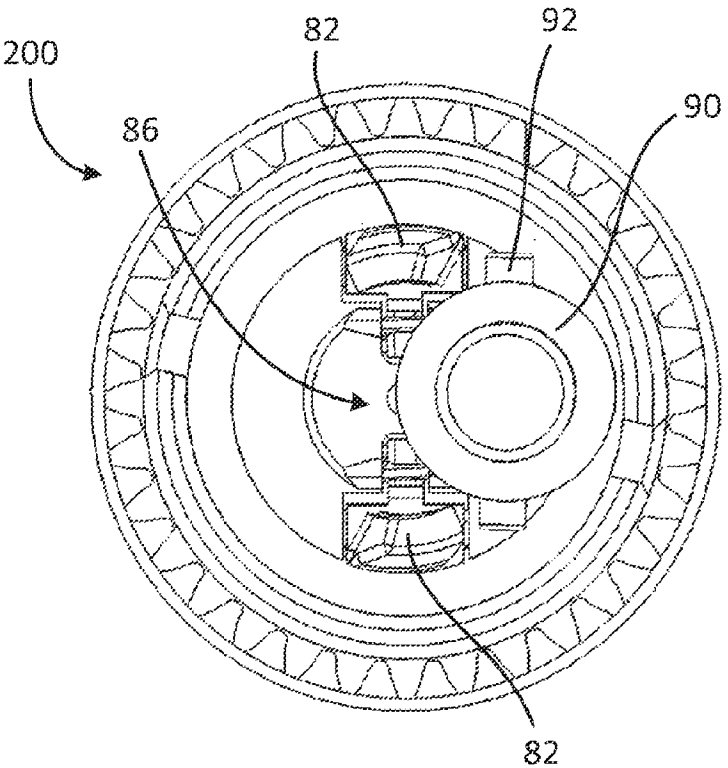
Figure 19:
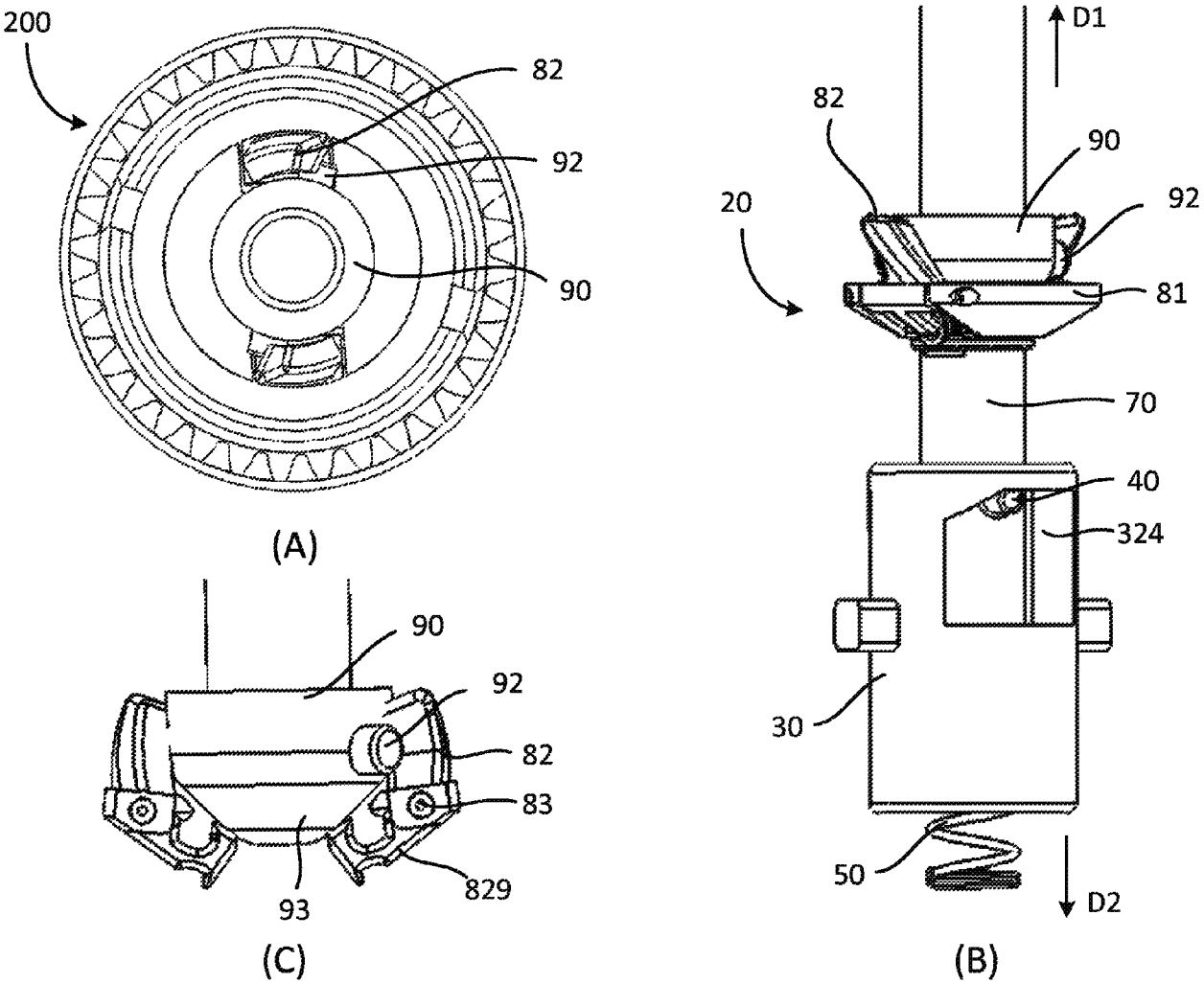

FIGS. 17-19 show a process how the transmission device 200 for a photosensitive drum according to the first embodiment of the present invention is connected with a drive member 90.

First, the transmission device 200 is positioned such that the drive member 90 is located between the two L-shaped engagement blocks 82, and is moved toward the drive member 90, as shown in FIG. 17. The pin 40 of the shaft 70 is in the middle position against the top side of the guiding grooves 324 of the sleeve 30, when the base 81 of the engagement structure 80 is touched by the drive member 90. Continuously moving of the transmission device 200 causes the drive member 90 to push the transmission unit 20 toward the second direction D2, which makes the pin 40 of the shaft 70 move down in the guiding groove 324 toward the second direction D2, as shown in FIG. 18, where the elastic member 50 is compressed toward the bottom wall 65 of the gear member 60. Meanwhile, the drive member 90 is slid into the receiving space 86 defined between the two L-shaped engagement blocks 82. When the drive member 90 is received in the receiving space 86 of the transmission unit 20, the compressed force generated by the elastic member 50 pushes the shaft 70 and makes the pin 40 of the shaft 70 back in the middle position against the top side of the guiding grooves 324 of the sleeve 30, where the engagement concaves 823 are engaged respectively with the pillars 92 of the drive member 90, as shown in FIG. 19. Because of the L-shaped design of the engagement blocks 82, when the pillars 92 of the drive member 90 are engaged with the engagement concaves 823, the bottom members 829 of the engagement blocks 82 are abutted against the body 93 of the drive member 90, as shown in FIG. 19C, which ensures no outward rotation of the engagement blocks 82 occurs when the transmission device 200 rotates to drive the drive member 90. In addition, the pulling force exerts on the hooks 826 of the two L-shaped engagement blocks 82 by the elastic ring 89' also makes the L-shaped engagement blocks 82 in the normal state during the operations.

FIGS. 20-23 show another process how the transmission device 100 for a photosensitive drum according to the first embodiment of the present invention is connected with a drive member 90. The L-shaped engagement blocks 82 are hereinafter denoted as an L-shaped engagement block 82A and an L-shaped engagement block 82B for the convenience of illustrating the engaging process more clearly.

Figure 20:
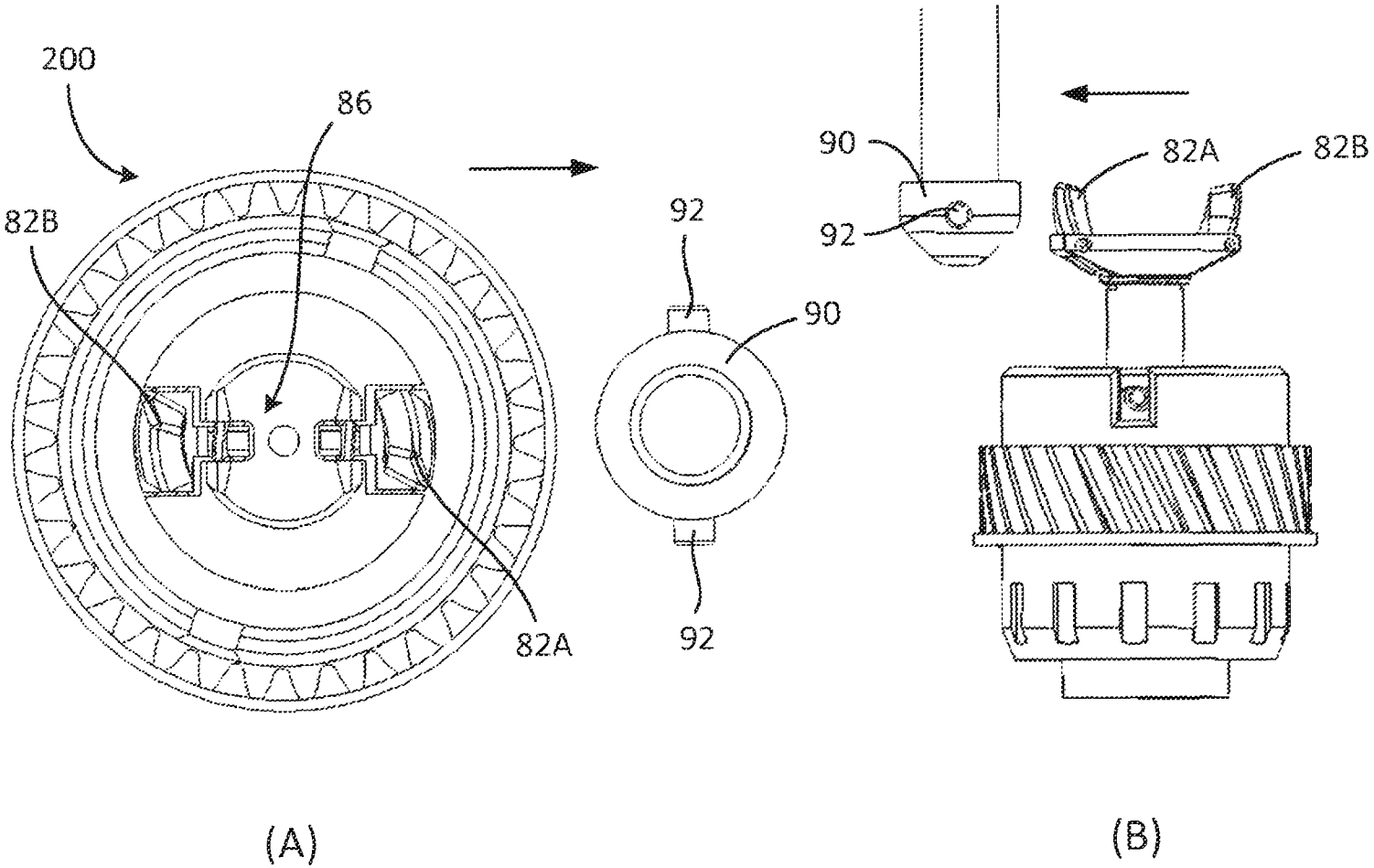
FIGS. 20-23 are views showing another process how a transmission device for a photosensitive drum is connected with a drive member according to another embodiment of the present invention.
Figure 21:
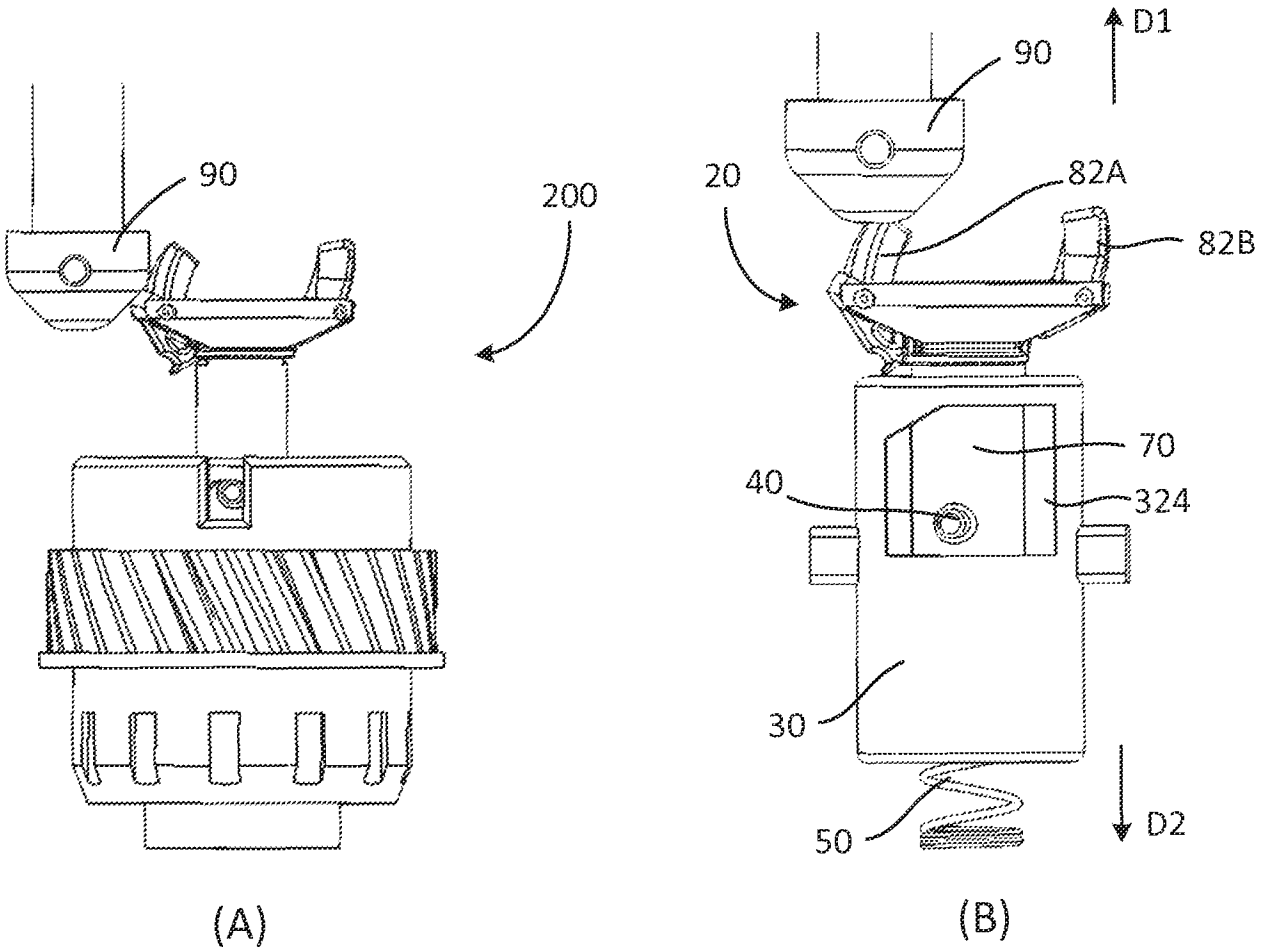
Figure 22:
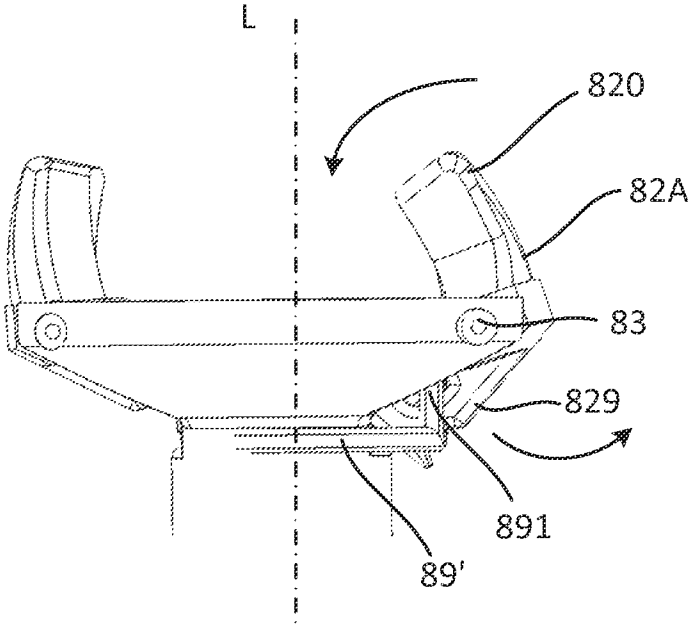
Figure 23:
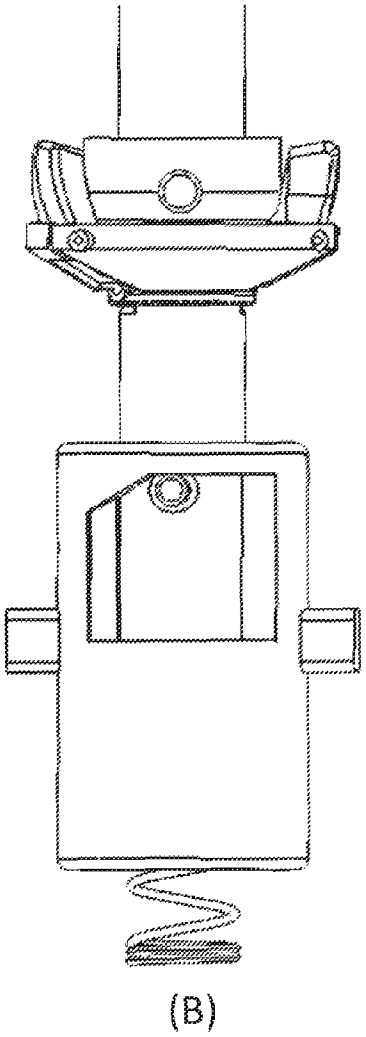
Figure 23:
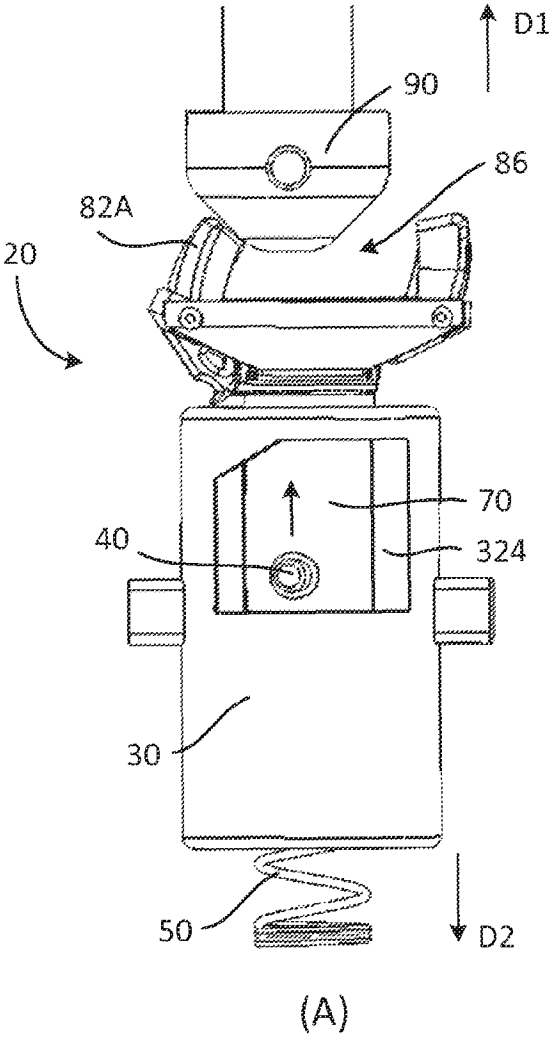

The transmission device 200 is first positioned such that the L-shaped engagement blocks 82B and 82A and the drive member 90 are aligned in a line or the like, and is moved toward the drive member 90, as shown in FIG. 20. When the outer surface 825 of the first L-shaped engagement block 82A is touched by the drive member 90, the pin 40 (i.e., protrusions 75) of the shaft 70 is in the middle position against the top side of the guiding grooves 324 of the sleeve 30. Continuously moving of the transmission device 200 causes the drive member 90 to push the L-shaped engagement block 82A of the transmission unit 20 to rotate inwardly around the pivotal axis 83, i.e., the engagement claw 820 of L-shaped engagement block 82A rotates toward the imaginary axis L while the bottom member 829 of the L-shaped engagement block 82A rotates outward the imaginary axis L, as shown in FIGS. 21A and 22. When the L-shaped engagement block 82A rotates to reach a limited angle at which the L-shaped engagement block 82A cannot rotate, further push of the drive member 90 to the L-shaped engagement block 82A causes the transmission unit 20 to move toward the second direction D2, which makes the pin 40 of the shaft 70 move down in the guiding groove 324 toward the second direction D2, as shown in FIG. 21B, where the elastic member 50 is compressed toward the bottom wall 65 of the gear member 60. The limited angle is determined by, for example, the barriers 818 of the base 81, as shown in FIG. 7, and/or the rotation limiting member 828 or 828', as shown in FIGS. 5 and 8.

When the transmission unit 20 moves toward the second direction D2 at an appropriate position, the drive member 90 is slid into the receiving space 86 defined between the two L-shaped engagement blocks 82, as shown in FIG. 23A When the drive member 90 is received in the receiving space 86 of the transmission unit 20, the compressed force generated by the elastic member 50 pushes the shaft 70 and makes the pin 40 of the shaft 70 back in the middle position against the top side of the guiding grooves 324 of the sleeve 30, as shown in FIG. 23B. The pulling force exerts on the hooks 826 of the two L-shaped engagement blocks 82 by the elastic ring 89' also makes the L-shaped engagement blocks 82 in the normal state during the operations.

When the pillars 92 of the drive member 90 are engaged with the engagement concaves 823, the bottom members 829 of the engagement blocks 82 are abutted against the body 93 of the drive member 90, as shown in FIG. 19C, which ensures no outward rotation of the engagement blocks 82 occurs when the transmission device 200 rotates to drive the drive member 90.

Figure 24:
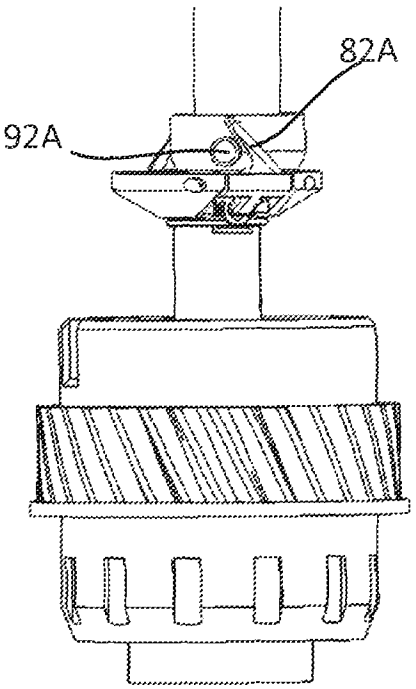
FIGS. 24-26 are views showing a process how a transmission device for a photosensitive drum is separated from the drive member according to one embodiment of the present invention.
Figure 24:
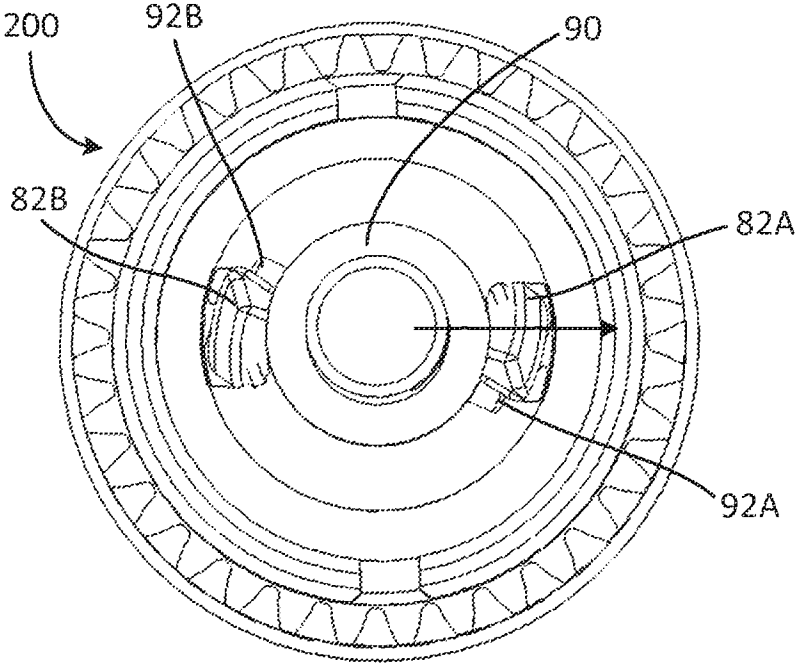
Figure 25:
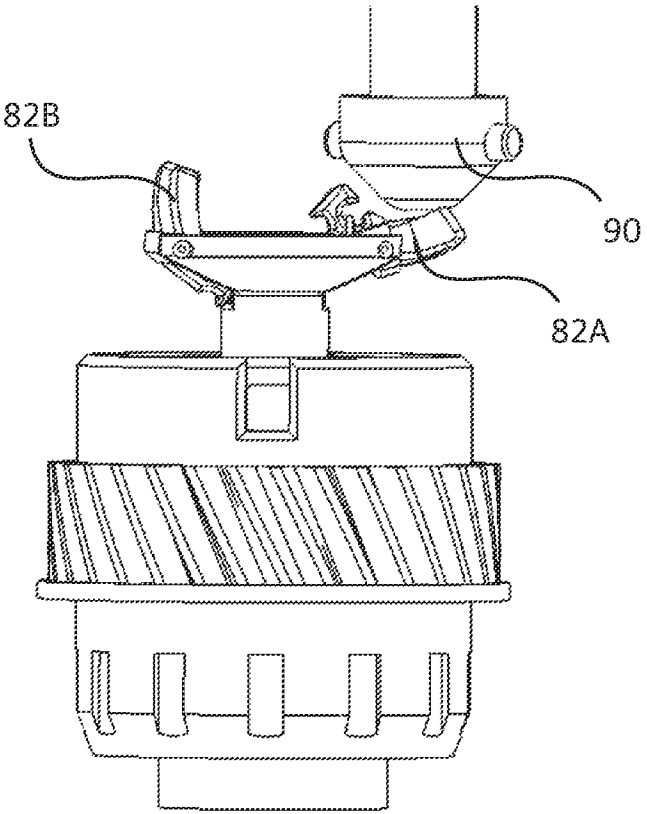
Figure 25:
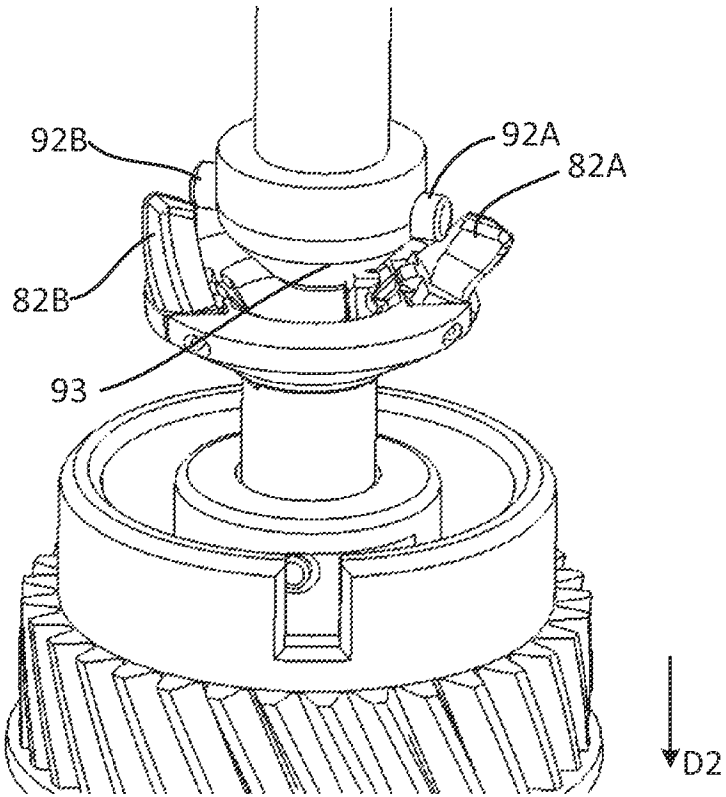
Figure 26:
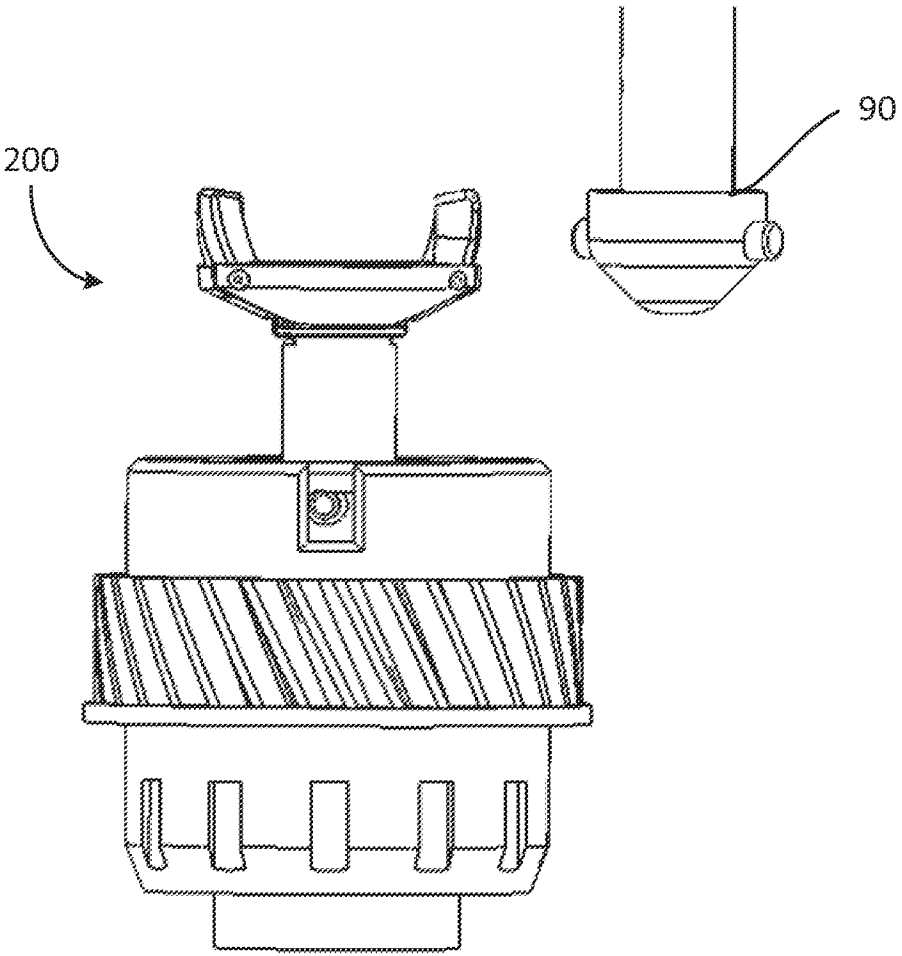

FIGS. 24-26 show a process how the transmission device 200 for a photosensitive drum is separated from the drive member 90 by moving the drive member 90 from the position shown in FIG. 24 toward the right direction, where the L-shaped engagement blocks 82 are also denoted as a first engagement block 82A and a second engagement block 82B and the pillars 92 of the drive member 90 are also denoted as a first pillar 92A and a second pillar 92B, for the convenience of illustrating the separating process more clearly. It is equivalent to moving the transmission device 200 from the position shown in FIG. 24 toward the left direction. At first, the second pillar 92B of the drive member 90 is separated from the second engagement block 82B directly, and the first pillar 92A and the body 93 of the drive member 90 push the first engagement block 82A, which causes the first engagement block 82A to rotate outward, as shown in FIG. 25A. Meanwhile, the transmission unit 20 is pushed toward the second direction D2. Continuous movements of the drive member 90 toward the right direction, or of the transmission device 200 toward the left direction, causes the first engagement block 82A to rotate farther outward, as shown in FIG. 25B. At this time, because the first engagement block 82A is still abutted against the body 93 of the drive member 90, and the transmission device 200 continuously moves toward the left direction, the transmission unit 20 and the sleeve 30 overcome the elastic rebound force generated by the elastic member 50 to cause the first pillar 92A to pass over the vertex 821 of the first engagement block 82A and then separated from it, as shown in FIG. 26. As a result, the transmission device 200 is separated from the drive member 90. In addition, the pulling force exerts on the hooks 826 of the two L-shaped engagement blocks 82 by the elastic ring 89 (or 89') makes the L-shaped engagement blocks 82 return in the normal state.

Figure 27:
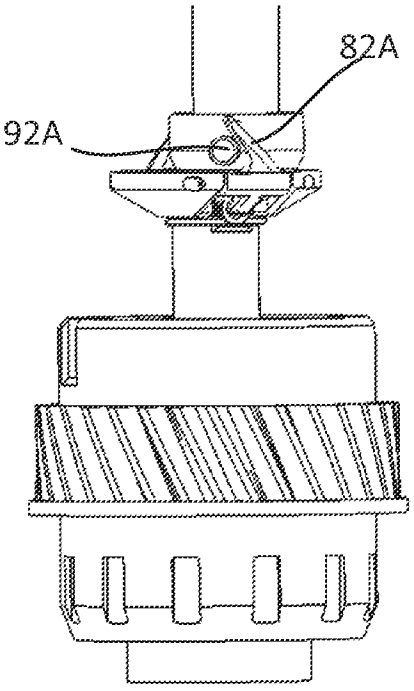
FIGS. 27-29 are views showing another process how a transmission device for a photosensitive drum is separated from the drive member according to another embodiment of the present invention.
Figure 27:
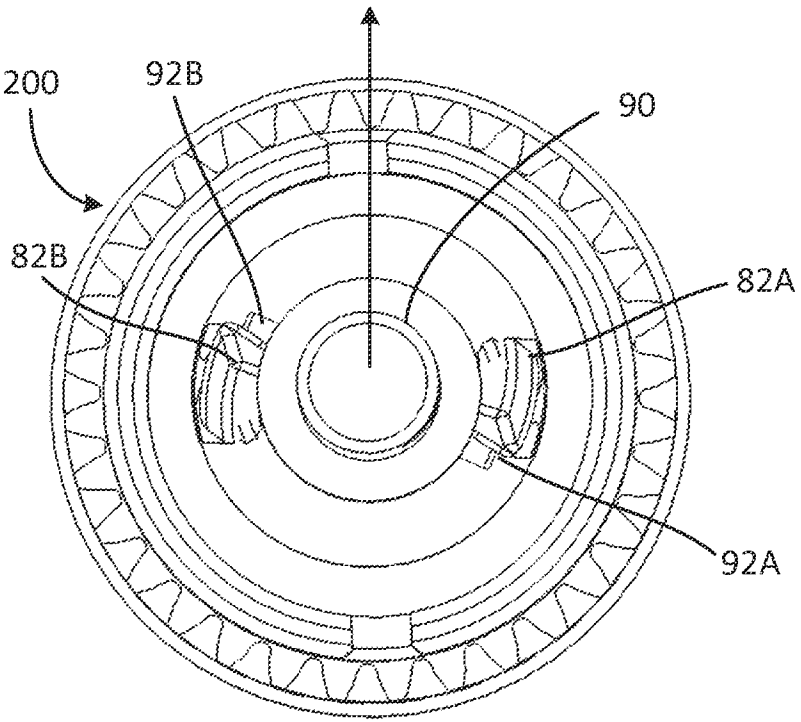
Figure 28:
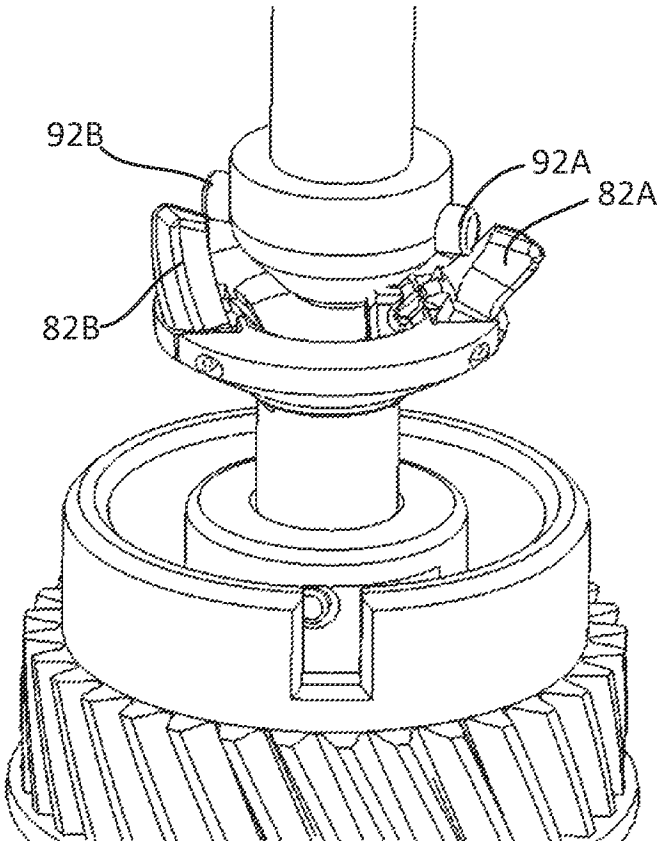
Figure 28:
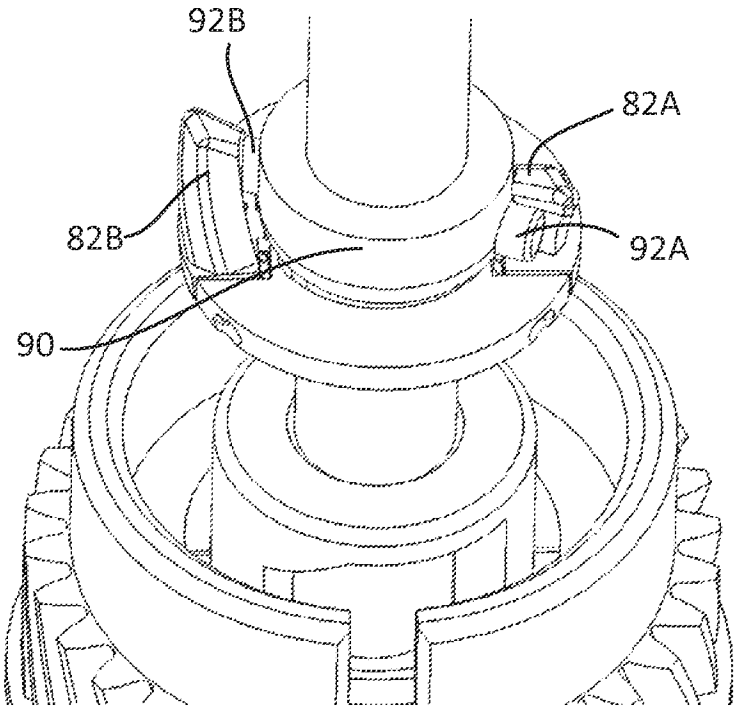
Figure 29:
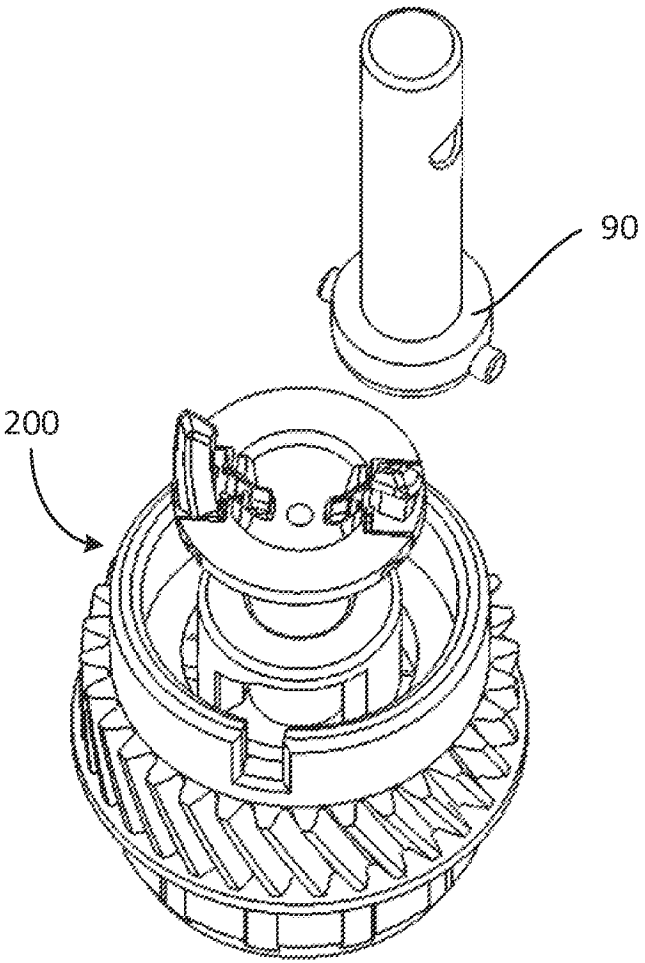

FIGS. 27-29 show another process how the transmission device 200 for a photosensitive drum is separated from the drive member 90 by moving the drive member 90 from the position shown in FIG. 27 toward the up direction, where the engagement blocks 82 are also denoted as a first engagement block 82A and a second engagement block 82B, and the pillars 92 of the drive member 90 is also denoted as a first pillar 92A and a second pillar 92B, for the convenience of illustrating the separating process more clearly. It is equivalent to moving the transmission device 200 from the position shown in FIG. 27 toward the down direction. At first, the second engagement block 82B is separated from the second pillars 92B directly, and the first engagement block 82A and the first pillar 92A push each other, which causes the first engagement block 82A to rotate outward, as shown in FIG. 28B. Meanwhile, the transmission unit 20 is pushed toward the second direction D2. Continuous movements of the drive member 90 toward the up direction, or of the transmission device 200 toward the down direction, causes the first engagement block 82A to rotate farther outward, as shown in FIG. 28B, so as to separate it from the first engagement block 82A, as shown in FIG. 29. As a result, the transmission device 200 is separated from the drive member 90. Similarly, after the transmission device 200 is separated from the drive member 90, the pulling force exerts on the hooks 826 of the two L-shaped engagement blocks 82 by the elastic ring 89 (or 89') makes the L-shaped engagement blocks 82 return in the normal state.

According to the present invention, the transmission device 200 for a photosensitive drum is simpler in structure than the conventional ones, and the way that the transmission device 200 is connected with and separated from the drive member 90 of an electronic image forming apparatus is different from the conventional ones. By the feature that the transmission unit 20 can move along the imaginary axis L and rotate about the imaginary axis L at the same time and the specially designed shape of the engagement blocks 82 of the transmission unit 20, no matter what angle the transmission device 200 is presented when entering or exiting the housing of the electronic imaging device, the transmission unit 20 will be connected with the drive member 90 firmly and separated from the drive member 90 smoothly.

The processes of how the transmission device 200 is connected with and separated from the drive member 90 are only possible ones of many conditions. For example, when the transmission device 200 is going to be connected with the drive member 90, the drive member 90 might first touch one of the engagement blocks 82 at its inner surface 824, or at its outer surface 825, as the condition illustrated before. However, the transmission device provided by the present invention can also be provided with more than two engagement blocks 82. Besides, the shape of the engagement concave 823 of each engagement block 82 is not limited to that provided in this embodiment, as long as the engagement concave 823 can be engaged with the pillar 92 of the drive member 90, and at the same time the pillar 92 can be hooked by a part of the engagement concave 823, e.g., the limiting surface 823*b* in the embodiment, to cause the transmission unit 20 unable to move toward the second direction D2 when the transmission unit 20 is driven to rotate.

Furthermore, the way that the sleeve 30 and the elastic member 50 are mounted in the gear member 60 is not limited to that provided in the embodiment. For example, the pillars 34 of the sleeve 30 and the limiting recesses of the gear member 60 can be replaced by recesses and protrusions, respectively. In another example, the bottom wall 65 of the gear member 60 can be mounted to the bottom portion 68 detachably so that the transmission unit 20 and the sleeve 30 coupled together and the elastic member 50 can be installed into the gear member 60 from its bottom; in this condition, the gear member 60 can be provided without the installation slot 62. The way that the sleeve 30 and the elastic member 50 are mounted in the gear member 60 also can be the design provided in the following embodiments.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A transmission device for a photosensitive drum, which is adapted for engagement with a drive member of an electronic image forming apparatus provided with two pillars, the transmission device comprising:

(a) a transmission unit comprising:

a shaft extending along an imaginary axis and having a first end facing toward a first direction, a second end facing toward a second direction opposite to the first direction, and at least one protrusion extending along a radial direction of the shaft; and an engagement structure comprising:

a base extending from the first end of the shaft;

a notched receptacle defined in the base;

two L-shaped engagement blocks, each L-shaped engagement block having a bottom member and an engagement claw, the bottom member having a first end portion defining a hook and an opposite, second end portion, and the engagement claw extending vertically from the second end portion of the bottom member, wherein the two L-shaped engagement blocks are pivotally received in two opposite sides of the notched receptacle, respectively, such that each L-shaped engagement block is rotatable around a pivotal axis at the second end portion of the bottom member, the pivotal axis being perpendicular to the imaginary axis, the first end portion of the bottom member is toward the imaginary axis and the engagement claw is helically toward the first direction in a normal state, and wherein the two L-shaped engagement blocks defines a receiving space therebetween for receiving the drive member; and a holding member engaged with the hook of the bottom member of each L-shaped engagement block;

(b) a sleeve having a main body, an axial hole defined through the main body along the imaginary axis, and at least one guiding groove formed on the main body and communicated with the axial hole, the shaft of the transmission unit being disposed in the axial hole and capable of rotating and moving axially, and the at least one protrusion of the shaft being movably retained in the at least one guiding groove;

(c) a gear member for engaging with the photosensitive drum, having a housing defined along the imaginary axis for receiving the main body of the sleeve so that the sleeve is coupled with the gear member unrotatably around the imaginary axis; and (d) an elastic member being disposed in the axial hole of the sleeve and having two ends abutted against a bottom wall of the gear member and the second end of the shaft of the transmission unit, respectively.

2. The transmission device as claimed in claim 1, wherein each engagement claw of each L-shaped engagement block has an outer surface extending gradually close to the imaginary axis toward the first direction, an inner surface facing the receiving space, an inclined top surface at a first junction between the outer surface and the inner surface, an engagement concave at a second junction between the outer surface and the inner surface, and a vertex located between the inclined top surface and the engagement concave, wherein an included angle between an extending direction of the inclined top surface and the imaginary axis is not equal to 90 degrees, and the engagement concaves of the engagement claws are opened substantially toward opposite directions for allowing the pillars of the drive member to enter the engagement concaves through openings of the engagement concaves.

3. The transmission device as claimed in claim 2, wherein the engagement concave of each engagement block of the transmission unit has a recess and a limiting surface located between the recess and the vertex and inclined substantially from the vertex toward the inclined top surface.

4. The transmission device as claimed in claim 1, wherein each L-shaped engagement block further has a rotation limiting member formed in the second portion of the bottom member and being toward the first end portion of the bottom member.

5. The transmission device as claimed in claim 1, wherein the first end portion and the second end portion of the bottom member of each L-shaped engagement block have a first width, W1, and a second width, W2, respectively, wherein the first width W1 is narrower than the second width W2.

6. The transmission device as claimed in claim 5, wherein the notched receptacle has two openings defined symmetrically in two opposite sides of the base, and two grooves defined recessively in the base and the shaft and being in communication with the two openings, respectively, and wherein each groove has a width, N1, and each opening has a width, N2, wherein the width N1 of each groove is narrower than the width N2 of each opening.

7. The transmission device as claimed in claim 6, wherein the two grooves are formed in the form of one groove.

8. The transmission device as claimed in claim 6, wherein when the two L-shaped engagement blocks are received in the notched receptacle, the second end portion of the bottom member of each L-shaped engagement block is received in a respective opening and the first end portion of the bottom member of each L-shaped engagement block is received in a respective groove.

9. The transmission device as claimed in claim 1, wherein each L-shaped engagement block further has a through hole defined in the second portion of the bottom member such that the through hole is coincident with the pivotal axis.

10. The transmission device as claimed in claim 9, wherein the base has two pairs of holes defined in communication with the notched receptacle.

11. The transmission device as claimed in claim 10, wherein when the two L-shaped engagement blocks are received in the notched receptacle, each L-shaped engagement block is pivotally attached to the base by a pin inserted through the through hole and a respective pair of holes of the base.

12. The transmission device as claimed in claim 1, wherein the hook of each L-shaped engagement block is a T-shaped hook.

13. The transmission device as claimed in claim 1, wherein the holding member comprises an elastic ring, a magnet, or a spring.

14. The transmission device as claimed in claim 13, wherein the elastic ring is formed of an elastic material comprising plastic, or silicon.

15. The transmission device as claimed in claim 13, wherein the elastic ring comprises two ear rings formed on the two opposite sides of the elastic ring.

16. The transmission device as claimed in claim 1, wherein the at least one guiding groove of the sleeve is formed in a shape of rectangle.

17. The transmission device as claimed in claim 16, wherein the at least one guiding groove of the sleeve has a bottom side substantially perpendicular to the imaginary axis, and two lateral sides respectively extending from two ends of the bottom side toward to the first direction, and a top side connected between the two lateral sides, and wherein the top side has a sloped portion and an extending portion parallel to the bottom side.

18. The transmission device as claimed in claim 1, wherein the sleeve further comprises two pillars protruding from the main body.

19. The transmission device as claimed in claim 1, wherein the shaft of the transmission unit has an opening in which a pin is inserted; the protrusion is a part of the pin sticking out of the opening.

20. The transmission device as claimed in claim 1, wherein the gear member has a top portion, a gear portion extending from the top portion along the imaginary axis toward the second direction, and a bottom portion extending from the gear portion along the imaginary axis toward the second direction.

21. The transmission device as claimed in claim 20, wherein the top portion of the gear member has at least one slot.

22. The transmission device as claimed in claim 20, further comprising:

a sleeve having a main body, an axial hole defined through the main body along the imaginary axis, and at least one guiding groove formed on the main body and communicated with the axial hole, the shaft of the transmission unit being disposed in the axial hole and capable of rotating and moving axially, and the at least one protrusion of the shaft being movably retained in the at least one guiding groove;

a gear member for engaging with the photosensitive drum, having a housing defined along the imaginary axis for receiving the main body of the sleeve so that the sleeve is coupled with the gear member unrotatably around the imaginary axis; and an elastic member being disposed in the axial hole of the sleeve and having two ends abutted against a bottom wall of the gear member and the second end of the shaft of the transmission unit, respectively.

23. A transmission device for a photosensitive drum, comprising a transmission unit, wherein the transmission unit comprises:

a shaft extending along an imaginary axis and having a first end facing toward a first direction, a second end facing toward a second direction opposite to the first direction, and at least one protrusion extending along a radial direction of the shaft; and an engagement structure comprising:

a base extending from the first end of the shaft;

a notched receptacle defined in the base;

two L-shaped engagement blocks, each L-shaped engagement block having a bottom member and an engagement claw, the bottom member having a first end portion defining a hook and an opposite, second end portion, and the engagement claw extending vertically from the second end portion of the bottom member, wherein the two L-shaped engagement blocks are pivotally received in two opposite sides of the notched receptacle, respectively, such that each L-shaped engagement block is rotatable around a pivotal axis at the second end portion of the bottom member, the pivotal axis being perpendicular to the imaginary axis, the first end portion of the bottom member is toward the imaginary axis and the engagement claw is helically toward the first direction in a normal state, and wherein the two L-shaped engagement blocks defines a receiving space therebetween; and a holding member engaged with the hook of the bottom member of each L-shaped engagement block.

* * * * *